US005625158A

United States Patent [19]

Ichiki

[11] Patent Number: 5,625,158

[45] Date of Patent: Apr. 29, 1997

[54] MUSICAL TONE GENERATING APPARATUS

[75] Inventor: Tetsuji Ichiki, Hamamatsu, Japan

[73] Assignee: Yamaha Corporation, Japan

[21] Appl. No.: 360,208

[22] Filed: Dec. 20, 1994

[30] Foreign Application Priority Data

Dec. 22, 1993 [JP] Japan ..... 5-325266

[51] Int. Cl.[6] ..... G10H 7/00

[52] U.S. Cl. ..... 84/603; 84/622

[58] Field of Search ..... 84/603, 604, 605, 84/606, 607, 622–625

[56] References Cited

U.S. PATENT DOCUMENTS

| | | | |
|---|---|---|---|
| 4,246,823 | 1/1981 | Wachi et al. | 84/1.22 |
| 4,781,096 | 11/1988 | Suzuki et al. | 84/1.01 |
| 5,094,136 | 3/1992 | Kudo et al. | 84/603 |
| 5,371,315 | 12/1994 | Hanzawa et al. | 84/603 |
| 5,416,264 | 5/1995 | Toda et al. | 84/603 |
| 5,432,293 | 7/1995 | Nonaka et al. | 84/607 |

*Primary Examiner*—William M. Shoop, Jr.
*Assistant Examiner*—Marlon T. Fletcher
*Attorney, Agent, or Firm*—Graham & James LLP

[57] ABSTRACT

A musical tone generating apparatus has an waveform memory which stores original waveform data. One or two tone generating chips are be able to fixed on a print circuit board as elements of the musical tone generating apparatus. Each tone generating chip, provided on the print circuit board, sequentially generates waveform data of a plurality of musical tones at sampling periods having a predetermined length under time division control. Each tone generating chip sequentially carries out tone generating operations to generate the waveform data based on the original waveform data during time division channels which are obtained by dividing each one of the sampling periods when the musical tone generating section is used for tone generation. In the case where one tone generating chip is employed on the print circuit board, N samples of the original waveform data are read out from the waveform memory during each one of the time division channels to be used by the tone generating chip. In the case where two tone generating chips are employed on the print circuit board, the number of the original waveform data read out from the waveform memory for each tone generating chip during each time division channel is decreased from N to M which is less than N.

10 Claims, 12 Drawing Sheets

U:SELECTOR 105 SELECTS THE FIRST INPUT TERMINAL
M:SELECTOR 105 SELECTS THE SECOND INPUT TERMINAL
L :SELECTOR 105 SELECTS THE THIRD INPUT TERMINAL

MUSICAL TONE GENERATING APPARATUS

BACKGROUND OF THE INVENTION

1. Field of the Invention

The present invention relates to musical tone generating apparatuses employed in electronic musical instrument for generating musical tones.

2. Background Art

Conventional electronic musical instruments are known in which musical tones are generated based on a plurality of waveform data stored in an waveform memory. The waveform data are digital data which are obtained by sampling a musical tone waveform by a predetermined sampling frequency. When generating a musical tone, tone generating operation is carried out in synchronization with change of sampling periods at which sample data of generated musical tones are to be outputted. In the tone generating operation, an address data, which increases over time at a rate corresponding to the tone pitch of the musical tone, is generated. A plurality of waveform data are read out from the waveform memory based on the integer portion of the address data and an waveform data corresponding to the address data is interpolated based on the waveform data thus read out and the fractional portion of the address data.

In the field of electronic musical instruments, the users require electronic musical instruments which can generate musical tones having high quality and can simultaneously generate many musical tones.

In order to obtain musical tones having high quality, high order interpolation method may be used for electronic musical instruments. In this case, many waveform data are read out from the waveform memory to be used for the interpolation. Therefore, long access time is necessary to supply the waveform data to the tone generating section of the electronic musical instrument.

In order to simultaneously generate many musical tones, time division control is used as control method of electronic musical instruments.

In this type of electronic musical instrument, waveform data corresponding to a plurality of musical tones are generated at sampling periods having a predetermined duration. Each sampling period is divided into a plurality of time division channels. Tone generating operations for generating the musical tones are sequentially carried out by using the time division channels.

In order to increase the number of musical tones to be simultaneously generated, the sampling period should be divided into many time division channels.

However, if the number of the time division channels are increased, the duration of each one of the time division channels become shorter. Therefore, it is difficult to obtain musical tones having high quality. Because, few waveform data can be read out from the waveform memory and the operation to obtain high quality musical tones, for example, high order interpolation, cannot be carried out.

Some users desire electronic musical instruments having an ability to simultaneously generate many musical tones having ordinary quality.

But, the other users require electronic musical instruments which can generate musical tones having high quality.

There are many requirements with respect to the function of electronic musical instruments.

In order to satisfy the requirements of all users, the maker should produce many types of electronic instruments which are required by the users.

However, it is difficult to satisfy such requirements because very high cost is required to produce many types of electronic musical instruments.

SUMMARY OF THE INVENTION

In consideration of the above, it is an object of the present invention to provide a musical tone generating apparatus which can be employed in various type of electronic musical instruments which can generate musical tones having high quality or can simultaneously generate many musical tones.

The present invention is to provide a musical tone generating apparatus operating based on time division control method using plural channels. The musical tone generating apparatus comprises waveform memory for storing original waveform data, and first tone generating means for generating plural addresses corresponding to said plural channels every sampling periods, and reading out N samples of said original waveform data according to each address for each channel from said waveform memory, and generating plural musical tones based on said N samples corresponding to said plural channels every sampling period. Second tone generating means for generating plural musical tones is able to be installed in said musical tone generating apparatus for the purpose of increasing the number of musical tones that can be generated by said musical tone generating apparatus at a time. The second tone generating means accesses the waveform memory together with the first tone generating means when the second tone generating means is used for tone generation. Access control means is further provided to said tone generating apparatus to decrease the number of samples of said original waveform data read for each channel from said waveform memory from N to M which is a number less than N, based on which said musical tone of each channel is generated, when the second tone generating means is installed.

Furthermore, the present invention is to provide another musical tone generating apparatus operating based on time division control method using plural channels. The musical tone generating apparatus comprises waveform memory for storing original waveform data, and first tone generating means for generating plural addresses corresponding to said plural channels every sampling period, and reading out N samples of said original waveform data according to each address for each channel from said waveform memory, and generating plural musical tones based on said N samples corresponding to said plural channels every sampling period. Second tone generating means for generating plural musical tones and buffer means are able to be installed in said musical tone generating apparatus for the purpose of increasing the number of musical tones that can be generated by said musical tone generating apparatus at a time. The second tone generating means accesses the waveform memory together with the first tone generating means when the second tone generating means is used for tone generation. The buffer means stores waveform data corresponding to the original waveform data which have been read out from the waveform memory during the past sampling period and supplies the short samples of said original waveform among said N samples, which cannot be read by said first tone generating means because of sharing access of said waveform memory with said second tone generating means, to said first tone generating means used for tone generation, when the second tone generating means is comprised.

Furthermore, the present invention is to provide another musical tone generating apparatus operating based on time division control method using plural channels. The musical tone generating apparatus comprises an waveform memory for storing original waveform data having a compressed form, address generating means for sequentially generating plural addresses corresponding to said plural channels every sampling periods for reading out the original waveform data from the waveform memory under time division control, buffer means for storing waveform data having a non-compressed form corresponding to the original waveform data which have been read out from the waveform memory in the past, data extending means for receiving the original waveform data read out from the waveform memory according to said addresses of each channel, and for carrying out extending operation on the original waveform data of each channel to obtain the waveform data having the non-compressed form based on the waveform data stored in the buffer means and for writing the waveform data of each channel obtained by the extending operation into the buffer means, and tone generating means for carrying out interpolations on the waveform data of each channel stored in the buffer means and the waveform data of each channel obtained by the extending operation and for generating a plurality of musical tones corresponding to said plural channels based on the results of the interpolation.

Furthermore, the present invention is to provide another a musical tone generating apparatus operating based on time division control method using plural channels. The musical tone generating apparatus comprises an waveform memory for storing original waveform data, address generating means for sequentially generating plural addresses corresponding to said plural channels every sampling periods, and outputting said plural addresses at predetermined timing to the waveform memory to read out the original waveform data from the waveform memory under time division control, and tone generating means for generating plural musical tones based on the original waveform data read out from the waveform memory and corresponding to said plural channels every sampling periods. Additional treatment means is able to be inserted between said waveform memory and said tone generating means to carry out an additional treat operation on the original waveform data read out from the waveform memory, and output waveform data as the result of the treat operation to said tone generating means, when the additional treatment means is comprised. Timing control means is further comprised in said musical tone generating apparatus to control said address generating means to output said plural addresses at the timing earlier than said predetermined timing to said waveform memory when said additional treatment means is comprised, so that the input timing of the waveform data into said tone generating means does not change irrespective of the installation of said additional treatment means.

Further objects and advantages of the present invention will be understood from the following description of the preferred embodiments with reference to the drawing.

DETAILED DESCRIPTION OF THE PREFERRED EMBODIMENTS (1) Overall Configuration

Figure 1:
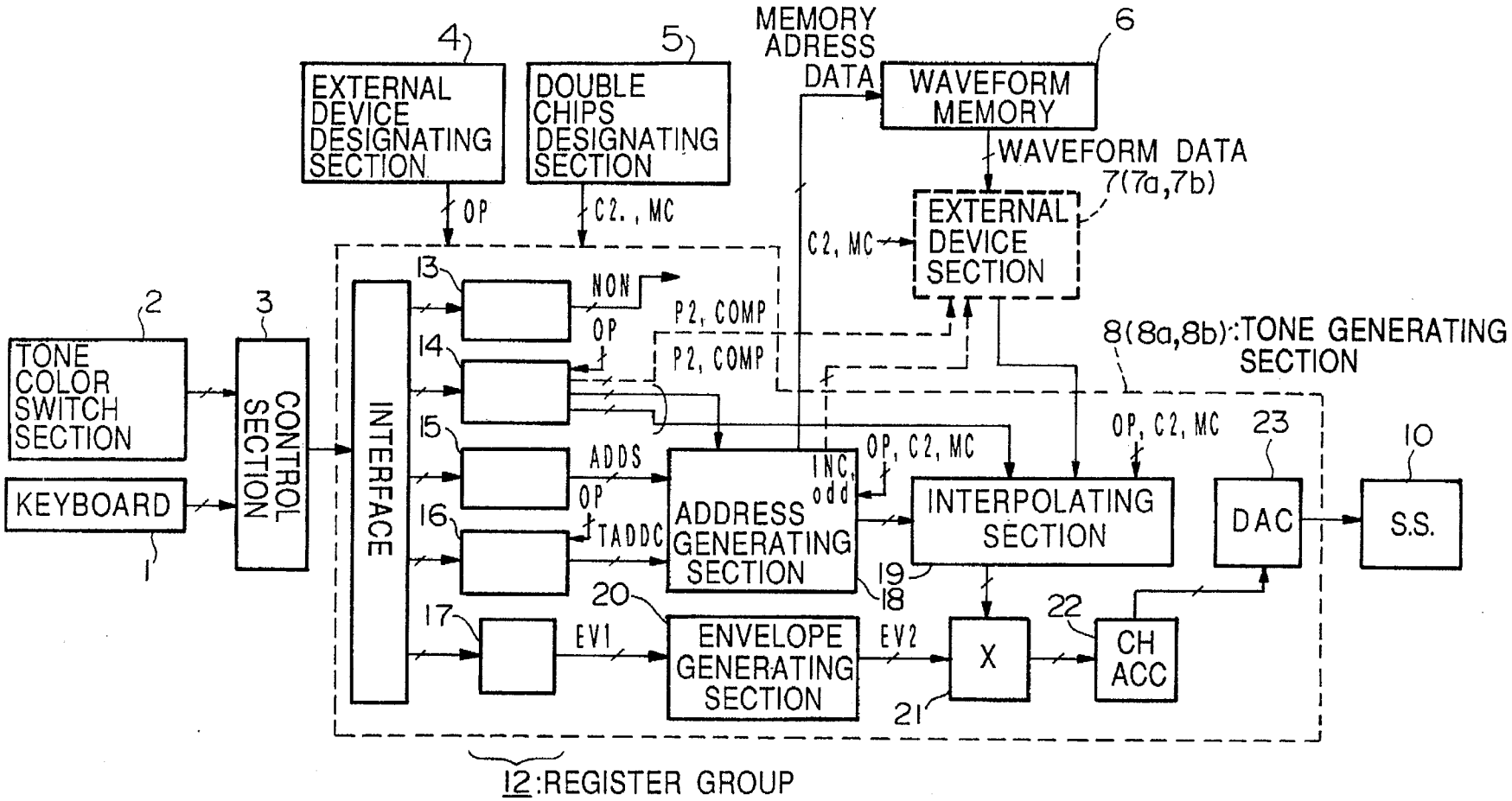
FIG. 1 is a block diagram showing the configuration of a electronic musical instrument comprising a musical tone generating apparatus according to a preferred embodiment of the present invention.

FIG. 1 is a block diagram showing the configuration of an electronic musical instrument according to a preferred embodiment of the present invention. In FIG. 1, the function blocks which consitute the electronic musical instrument are illustrated by boxes which are assigned with numerals. Some of the function blocks are ICs (Integrated Circuits), LSIs (Large Scale integrated Circuits) or other electronic devices. These blocks are fixed on a printed circuit board (not shown) which is provided in the electronic musical instrument. In FIG. 1, 1 designates a keyboard having a plurality of white keys and a plurality of black keys which are depressed by performers. 2 designates a tone color switch section which is provided on a control panel (not shown) of the electronic musical instrument for performers to designate a tone color of musical tones to be generated. 3 designates a control section constructed by devices such as a microcomputer. The control section 3 is fixed on the printed circuit board. The key on-events or key-off events of these keys are sensed by a control section 3. The designated tone color is sensed by the control section 3 based on the operation applied to the tone color switch section 2. The control section 3 controls the tone generating operation of the electronic musical instrument based on a prestored control program.

4 designates an external device designating section. When any external device is not fixed on the printed circuit board of the electronic musical instrument, the external device designating section 4 outputs an external device detection signal OP which has the value [0]. In contrast, when an external device is fixed on the printed circuit board of the electronic musical instrument, the external device designating section 4 outputs the external device designating signal OP which has one of values [1], [2] or [3]. The external device designating signal OP designates a delay time which is generated due to the external device.

8 designates a tone generating section for generating musical tones. One or two tone generating chips (LSI chip) may be fixed on the printed circuit board of the electronic musical instrument as tone generating section 8. FIG. 1 shows a case in which two tone generating chips 8*a* and 8*b* are employed as tone generating section 8.

5 designates a double chips designating section. When the two tone generating chips 8*a* and 8*b* are fixed on the printed circuit board to be used for tone generation, the double chips designating section 5 outputs a double chip signal C2 having the value [1]. in this case, one of the two chips acts as a master tone generating chips and the other acts as a slave tone generating chips. The double chip designating section 5 supplies a master signal MC having the value [1] to the master tone generating chip and a master signal MC having the value [0] to the slave tone generating chip. In the following description of the preferred embodiment, the tone generating chip 8*a* is the master tone generating chip and the tone generating chip 8*b* is the slave tone generating chip.

6 designates an waveform memory which stores compressed waveform data and non-compressed waveform data which are not compressed. The memory map off the waveform data will be described later. When generating musical tones, address data are sequentially supplied to the waveform memory 6 by the tone generating section 8. As a result, the waveform data corresponding to the address data thus supplied are sequentially read out from the waveform memory 6.

7 designates an external device section for carrying out a additional treatment operation on the waveform data read out from the waveform memory. One or two external devices (LSI chips) may be fixed on the printed circuit board of the electronic musical instrument. In this preferred embodiment, a decoding operation for compressed waveform data is carried out by the external section as the additional treatment operation. In the case where the read out operation to the waveform memory 6 is carried out by two tone generating chips, the waveform data are read out from the waveform memory 6. In this case, two external devices 7*a* and 7*b* are necessary. The operation of the external devices are used when the operation is necessary. When the operation of the external device is not required, the waveform data supplied to the device are supplied to the interpolation section 19 in its original form. That is to say, the external device 7*a* or 7*b* is a connectable and removable element which may be inserted between the waveform memory 6 and the tone generating section 8. The external device 7*a* or 7*b* is controlled based on the double chip signal C2, the master signal MC and an increment signal INC. The external device 7*a* or 7*b* decodes the waveform data, which are supplied from the waveform memory 6, based on the increment signal INC which is supplied from the tone generating section 8. The decoded waveform data are supplied to the tone generating section at a predetermined timing.

Each one of the tone generating chips 8*a* and 8*b* is an element which can generate thirty two musical tones simultaneously under the time division control using thirty two time division channels. The tone generating process for generating each musical tone is carried out by using one of the thirty two time division channels. In the tone generating process, the tone generating chip 8*a* or 8*b* generates the address data of the waveform data, which are to be read out the waveform memory 6, and carries out an interpolation operation, an envelope multiplying operation and D/A conversion operation. An analog musical tone signal is generated through these processing operations and is supplied to a sound system 10 such as a loud-speaker. The musical tone signal is outputted from the speaker as a musical sound.

(2) Configuration of Tone Generating Chip 8*a* or 8*b*

As shown in FIG. 1, each tone generating chip has an interface 11, a register group 12, an address generating section 18, an interpolation section 19 and an envelope generating section 20. These elements 11 to 20 simultaneously generate independent musical tone signals under the time division control using thirty two time division channels. Furthermore, the tone generating section 8 has a channel accumulating section 22 and a DAC (Digital to Analog Converter) 23. The sampling frequency of the DAC 23 is 50 kHz and the sampling period 1/50 kHz is divided into thirty two time division channels. That is to say, the time division channel is changed at a frequency of 32*50 kHz= 1.6 MHz.

The interface 11 receives control signals from the control section 3 and stores the signal in the register group 12.

The register group 12 includes the following register sections 13 to 17. Each register section has registers corresponding to the thirty two time division channels.

<Note on register section 13>

This register section stores note on signals. When a key-on event is detected from the keyboard 1, and the time division channel, which is to bc used for generating the musical tone corresponding to the key-on event, is selected, a note on signal is written in one of the registers which corresponds to the selected time division channel. Note on signals stored in the note on register section 13 are monitored by the other elements in the tone generating chip.

<Decoding control register section 14>

This register section 14 stores compression control signals COMP and interpolation control signals P2 for thirty two time division channels. The signals COMP and P2 for thirty two time division channels are independently written in the decoding control section 14 by the control section 3. The compression control signals COMP designate the compression mode of the waveform data which are read out from the waveform memory 6 during the present time division channel. When the compressed waveform data are read out, the compression control signal COMP having the value [1] is written in the decoding register section 14 prior to the read out operation. In contrast, when the non-compressed waveform data is to be read out, the compression control signal COMP having the value [0] is written.

The interpolation control signals P2 designate the interpolation methods which are to be used for the tone generating operation during the present time division channel. When two points interpolation to interpolate an waveform data based on two original waveform data is selected, the interpolation control signal P2 having the value [1] is written in the decoding register section 14. In contrast, when four points interpolation to interpolate an waveform data based on four original waveform data is selected, the interpolation control signal P2 having the value [0] is written.

The interpolation control signals P2 are supplied to interpolating section 19 at standard timing. The compression mode signals COMP are supplied to the external device 7 and to the address generating section 18 at earlier timing which is earlier than the standard timing by a delay time which is designated by the external device designating signal OP. Furthermore, the interpolation control signals P2 are supplied to address generating section 18 at the earlier timing.

<Address Control Register Section 15>

This register section 15 stores address control signals ADDC for controlling the read out operation of the waveform data.

<Leading Address Control Register Section 16>

This register section 16 stores leading address control signals TADDC used for determining the leading addresses of the read out waveform data.

<Envelope Control Register Section 17>

This register section 17 stores envelope control signals EV1 controlling the envelopes which are applied to waveform data generated using time division channels.

The address generating section 18 generates waveform address data and generates memory address data ADD, signal ODD and the increment signal INC based on the waveform address data.

Waveform address data are serial number which are assigned to waveform data constituting a waveform. Memory address data designate the memory locations of the waveform memory.

The address generating section 18 generates waveform address data, which increases over time at a rate corresponding to the tone pitch of a musical tone to be generated, for each time division channel. The address generating section 18 generates the memory address data corresponding to the waveform address data thus generated based on the address control signal ADDC, the leading address control signal TADDC, the external device designating signal OP, the double chip signal C2, the master signal MC.

The memory address data ADD are outputted from the address generating section 18 to the waveform memory 6 at the earlier timing which is earlier than the standard timing by the delay time designated by the external device designating signal OP. Furthermore, the increment signal INC and the signal ODD are supplied to the external device 7 at the earlier timing. The fractional portion of the waveform address data is outputted from the address generating section 18 to the interpolating section 19 at the standard timing.

The interpolation section 19 carries out an interpolation on the waveform data which are read out from the waveform memory 6. This interpolation is controlled based on the interpolation control signal P2, the external device designating signal OP, the double chip signal C2 and the master signal MC. The interpolation section 19 interpolates the waveform data based on the fractional portion of the waveform address data and outputs the interpolated waveform data having a phase corresponding to the waveform address data. The output waveform data of the interpolation section 19 are supplied to the envelope multiplying section 21.

The envelope generating section 20 sequentially generates envelope signals EV2 which are to be applied to waveform data regenerated through the thirty two time division channels. The waveform of the envelope signals EV2 are controlled based on the envelope control signal EV1. The envelope signals EV2 corresponding to the thirty two time division channels are supplied from the envelope generating section 20 to the envelope multiplying section 21. The supply timing of the envelope signals EV2 are synchronized to the supply timing of the waveform data at which the waveform data corresponding to the thirty two time division channels are sequentially supplied to the envelope multiplying section 21.

The envelope multiplying section 21 sequentially multiplies the waveform data from the interpolation section 19 and the envelope signal EV2 from the envelope generating section 20 in synchronization with the changing of the time division channel and sequentially outputs the multiplied results to the channel accumulating section 22.

The channel accumulating section 22 accumulates the multiplied results corresponding to the thirty two time division channels and outputs the accumulated data as waveform data of a waveform defining a plurality of musical tones at the sampling frequency of 50 kHz.

The DAC 23 converts the output signal of the channel accumulating section 22 to an analog musical tone signal and outputs the analog signal to the sound system 10.

(3) Example of Electronic Musical Instruments Employing the Preferred Embodiments of the Present Invention Various types of electronic musical instruments can be provided according to the present invention. The description will be given with respect to the connection configuration of the tone generating section 8 and the waveform memory 6 in these electronic musical instruments.

Figure 2A:
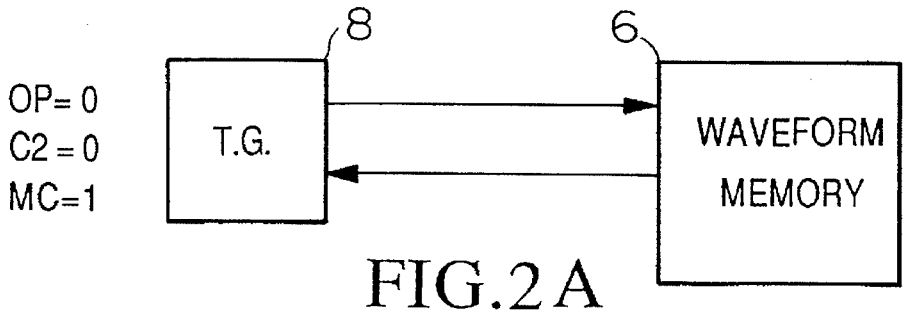
FIGS. 2A to 2D show configurations of four types of electronic musical instruments which employ the musical tone generating apparatus according to the preferred embodiment of the present invention.

FIG. 2A is a block diagram showing a configuration of a first type electronic musical instrument in which one tone generating chip 8*a* and the waveform memory 6 are fixed on the print circuit board of the electronic musical instrument. In this configuration, the tone generating section 8 (i.e., the tone generating chip 8*a*) can always access the waveform memory 6 and can read out four waveform data from the waveform memory 6 by using four time slots during one time division channel. Therefore, the interpolation section of the tone generating section 8 can carry out an interpolation on the waveform data by using four waveform data. In this case, the external device designating signal OP is set as [0]. The double chip signal C2 is set as [0]. The master signal MC is set as [1].

Figure 2B:
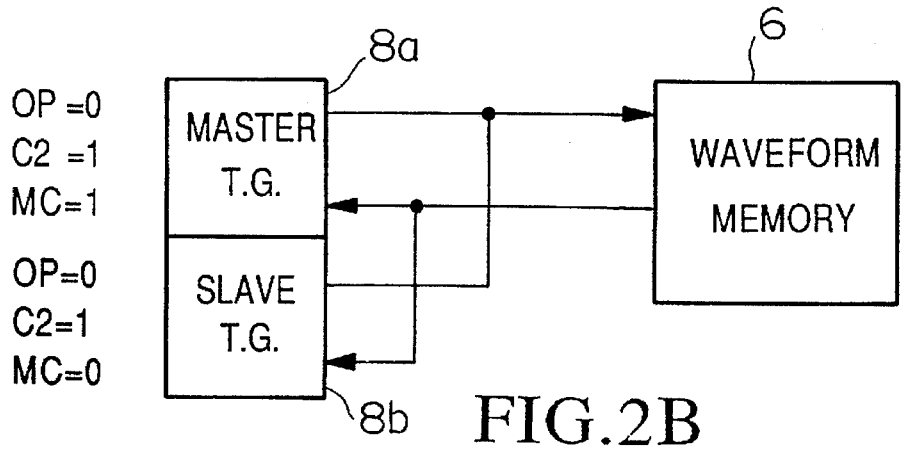

FIG. 2B is a block diagram showing the configuration of a second type of electronic musical instrument in which two tone generating chips 8*a* and 8*b* are fixed on the printed circuit board and the waveform memory 6 is accessed by the tone generating chips 8*a* and 8*b*. In this configuration, the tone generating chips 8*a* and 8*b* can alternatively access the waveform memory 6. Each tone generating chip can simultaneously generate thirty two musical tones by using thirty two time division channels. Therefore, sixty four musical tones may be simultaneously generated by the tone generating chips 8*a* and 8*b*. However, each one of the tone generating chips can read out only two waveform data by using two time slots during one time division channel. Therefore, the interpolation section of each tone generating chip can carry out an interpolation on two waveform data. In this case, the external device designating signal OP having the value [0] and the double chip signal C2 having the value [0] are supplied to the tone genes-acing chips 8*a* and 8*b*. The master signal MC having the value [1] is supplied to the tone generating chip 8*a*, while the master signal MC having the value [0] is supplied Lo the tone generating chip 8*b*.

Figure 2C:
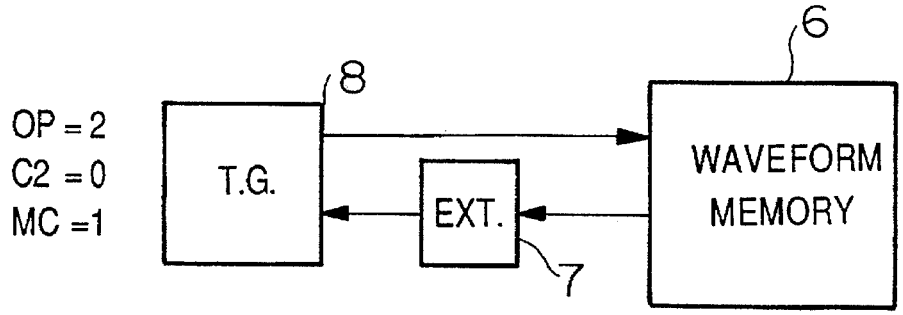

FIG. 2C shows the configuration of a third type of electronic musical instrument in which one tone generating chip 8*a* is fixed on the printed circuit board as the tone generating section 8 for regenerating the waveform data stored in the waveform memory 6 and an external device 7*a* is inserted between the tone generating section 8 and the waveform memory 6 as external device section 7. In this configuration, the tone generating chip 8*a* can read out four waveform data from the waveform memory 6 by using four time slots during one time division channel. Therefore, the interpolation section of the tone generating section 8 can interpolates the waveform data by using four waveform data. In this configuration, furthermore, compressed waveform data and non-compressed waveform data can be read out from the waveform memory 6 and the compressed waveform data are decoded to non-compressed waveform data by the external device 7. In this case, the external device designating signal OP is set as [1]. The double chip signal C2 is set as [0]. The master signal MC is set as [1]. When regenerating the compressed waveform data, the tone pitch of the waveform data regenerated by the tone generating chip should be equal to or less than four times of the tone pitch of the compressed waveform data stored in the waveform memory 6 (i.e., the F-number is limited within [4]).

Figure 2D:
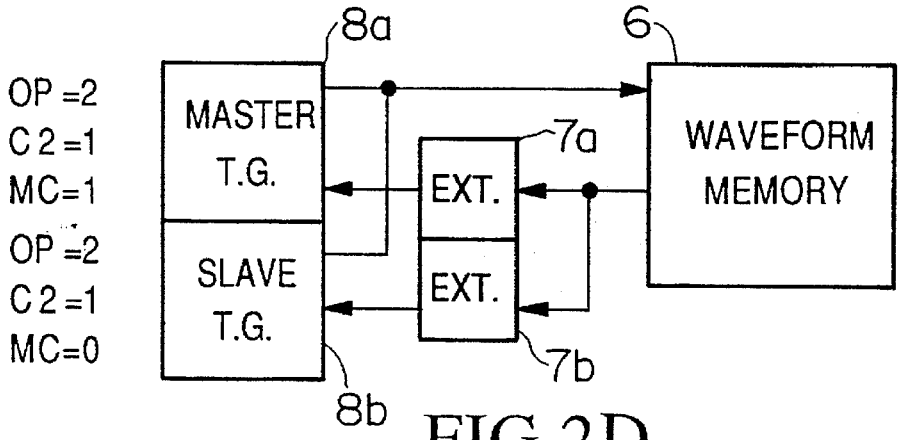

FIG. 2D shows the configuration of a fourth type of electronic musical instrument in which two tone generating chips 8*a* and 8*b* are fixed on the printed circuit board to be used for regenerating the waveform data stored in the waveform memory 6. Furthermore, two external devices 7*a* and 7*b* are respectively inserted between the Lone generating chip 8*a* and the waveform memory 6 and between the tone generating chip 8*b* and the waveform memory 6. In this configuration, sixty four musical tones may be simultaneously generated by the tone generating chips 8*a* and 8*b*. Each tone generating chip can read out only two waveform data from the waveform memory 6 by using two time slots during one time division channel. However, each one of the external devices 7*a* and 7*b* supplies to the tone generating chip 8*a* or 8*b* four waveform data which have been previously read out from the waveform memory 6 and stored in the external devices. That is to say, the external devices act as a buffer to supply the waveform data for the interpolation. Therefore, the interpolation section of each tone generating chip can interpolate the waveform data by using four waveform data if necessary. Compressed waveform data and non-compressed waveform data can be read out from the waveform memory 6 and the compressed waveform data are decoded to non-compressed waveform data by the external devices 7*a* and 7*b*.

When regenerating the waveform data having a tone pitch equal to or less than the tone pitch of the waveform data stored in the waveform memory 6, the regeneration is carried out by using the four points interpolation. In contrast, when regenerating the waveform data having a tone pitch much greater than the tone pitch of the waveform data stored in the waveform memory 6, the regeneration is carried out by using the two points interpolation.

In this case, the external device designating signal OP having the value [2] and the double chip signal C2 having the value [1] are supplied to the tone generating chips 8*a* and 8*b*. The master signal MC having the value [1] is supplied to the tone generating chip 8*a*, while the master signal MC having the value [0] is supplied to the tone generating chip 8*b*.

Figure 3:
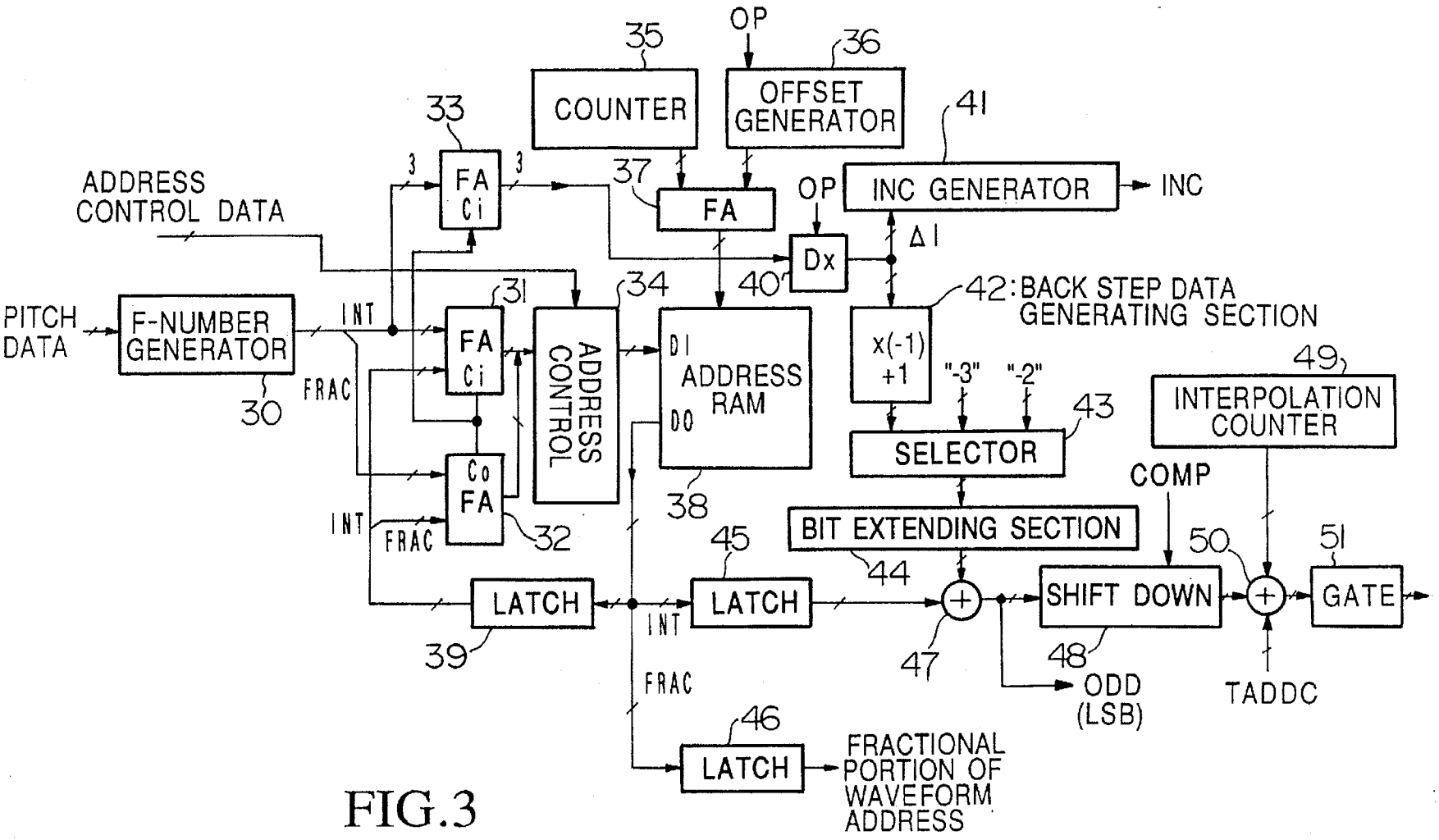
FIG. 3 is a block diagram showing the configuration of an address generating section of the electronic musical instrument shown in FIG. 1.

(4) Configuration of Address Generating Section 18 of Each Tone Generating Chip FIG. 3 is a block diagram showing the configuration of the address generating section 18. In FIG. 3, 30 designates a F-number generator. The F-number generator 30 sequentially generates F-numbers corresponding to the tone pitches of the musical tones which are to be generated by using the thirty two time division channels. The F-numbers consist of integer portion and fractional portion. The integer portions INT of the F-numbers are sequentially supplied to a full adder 31 and to a half adder 33 in synchronization with the change of the time division channel. The fractional portions FRAC of the F-numbers are also sequentially supplied to a full adder 32. The full adders 31 and 32 sequentially receive waveform address data from an address RAM 38 in synchronization with the changing of the time division channel via a latch 39. The full adders 31 and 32 sequentially add the address data corresponding to the time division channels with the F-numbers corresponding to those to vary the waveform address data at rates corresponding to the tone pitches of the musical tones to be generated.

The full adder 32 supplies a carry out signal to the full adder 31 and to the half adder 33 as carry input signals. The waveform address data outputted by the full adders 31 and 32 are supplied to the address control section 34. The address control section 34 carries out an address control operation, for example, a control for loop regeneration to regenerate the attack portion of a musical tone and repeatedly regenerate the sustain portion of the musical tone.

A channel counter 35 counts in synchronization with the changing of the time division channel and supplies the count value to one of the input terminals of a full adder 37. An off set generator 36 sequentially generates off set values to the other of the input terminals of the full adder 37. The full adder 37 adds the count value and the off set value and supplies the added result to the address RAM 38 as a address.

The address RAM 38 is accessed in synchronization with the changing of time slots which are obtained by dividing each time divisional channel by four.

Figure 4:
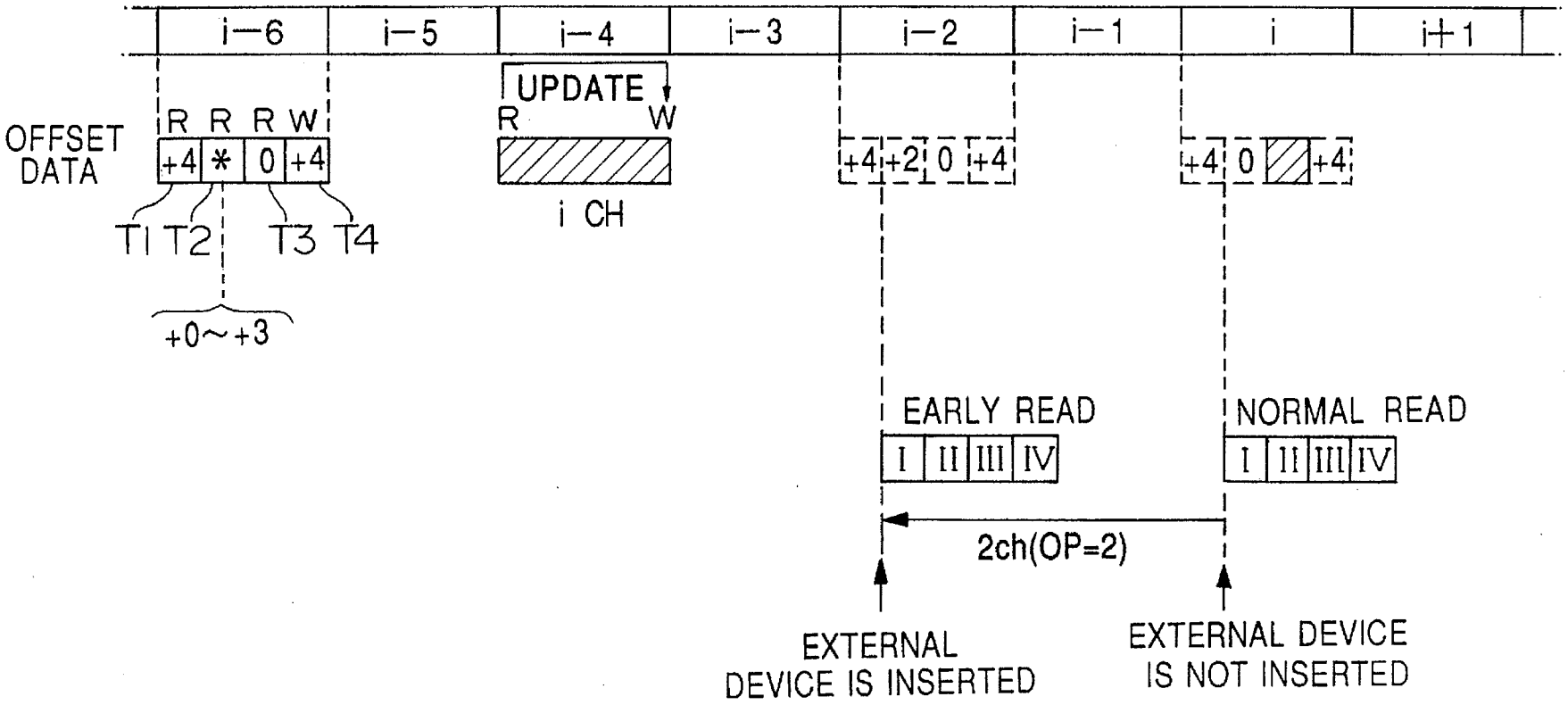
FIG. 4 is a time-chart showing the operation of the electronic musical instrument shown in FIG. 1.

FIG. 4 is a time chart showing the time division control for the address generation. In this embodiment, the access operation for the address RAM 38 is carried out in synchronization with the time slots. The RAM access operations for the thirty two time division channels are executed at a time division operation by using the time slots. During each time slot, the count value of the channel counter 35 and the offset value outputted by the offset generator 36 are added by the full adder 37. The added result designates the channel number of the time division channel corresponding to the RAM access operation to be carried out. In other words, during each time slot, the RAM access operation for the time division channel designated by the added result of the Full adder 37 is to be carried out.

In FIG. 4, a stripe is illustrated at top of the drawing and the stripe is divided into a plurality of rectangles. These rectangles indicate the time division channels. Symboles i–6, i–5, i–4, i–3, i–2, i–1, i. i+1 are written in the rectangles to indicate the channel numbers of the time division channels. The time division channel i is the time division channel corresponding to the present time. The time division channel i–1 is one time division channel older than the present time division channel.

Time slots are indicated under the stripe indicating the time division channel. As shown in this drawing, one time division channel is divided into four time slots T1 to T4. During each one of time slots T1 to T4, the RAM access operation is carried out as follows:

During the time slot T1, the full adder 37 adds the count value of the channel counter 35 with the offset value and the added result is supplied to the address RAM 38 as a read-out address. As a result, the waveform address data, which consists of the integer and fractional portions and corresponds to the read-out address is read out from the address RAM 38. The address data thus read-out is held by the latch 39. During the time slot T1, the offset value [+4] is generated. Thus, during the time slot T1 of the time division channel i, the value i+4 is supplied to the address RAM 38 and the waveform address data corresponding to the channel number i+4 is read-out from the address RAM 38. In other words, the waveform address data corresponding to the current channel number i has previously been read out from the address RAM during the time slot T1 of the time division channel 1–4 which is four time division channels older than the present time division channel i.

During the time slot T2, the count value of the channel counter 35 is added with the offset value. The added result is supplied to the address RAM 38 as the read out address. As a result, the waveform address is read out from the address RAM 38 and the integer portion of the waveform address is latched by the latch 45. During the time slot T2, the offset value is determined based on the existence of the external device 7. If no external device is used for tone generation, the offset value is determined as [0]. If any external device is used for tone generation, the offset value is determined as [+1] or [+2] or [+3]. In this case, the offset value is determined based on the operational speed of the external device. In this preferred embodiment, the external devices *7a* and *7b* have a delay time corresponding to the offset value of [+2]. Therefore, the external device designating signal OP is set as [2] and the offset value is thereby set as [+2]. The delay time of the external device is determined due to the internal operation of the external device. Therefore, the value of the external device designating signal OP is determined based on the internal operation of the external device.

Next, during the third time slot T3, the count value of the channel counter 35 is added with the offset value. The added result is supplied to the address RAM 38 as the read out address. As a result, the waveform address is read out from the address RAM 38 and the fractional portion of the waveform address is latched by the latch 45. In this preferred embodiment, the value [0] is outputted as the offset value during the time slot T3. Therefore, the fractional portion of the waveform address corresponding to the present time division channel is outputted from the address RAM 38.

Next, during the time slot T4, the count value of the channel counter 35 is added with the offset value. The added result is supplied to the address RAM 38 as the write address. As a result, the waveform address updated by the full adders 31, 32 and the address control section 34 is written in the address RAM 38. As like to the time slot T1, the value of [+4] is outputted as the offset value during the time slot T4.

In this manner, the waveform address corresponding to the coming time division channel, which will be presented four time division channel after the present time division channel, is updated and the waveform address thus updated is written in the address RAM 38 during the present time division channel.

If any external device is not connected to the tone generator, the waveform address corresponding to the present time division channel i has been read out from the address RAM 38 during the first time slot T1 of the past time division channel i–4, which is four time division channels before the present time division channel i. The waveform address thus read out has been updated and the waveform address thus updated has been written in the address RAM 38 during the fourth time slot T4 of the same time division channel i–4. The integer and fractional portions of the waveform address, which has been updated during the past time division channel i–4, are sequentially read out from the address RAM 38 during the time slots T2 and T3 of the present time division channel i.

In contrast, if the external device 7 is used for tone generation and the external device signal OP having the value [2] is outputted, the waveform address corresponding to the present time division channel i has been updated during the the past time division channel i–4, which is four time division channels before the present time division channel i. The integer and fractional portions of the waveform address thus updated have been sequentially read out from the address RAM 38 during the time slots T2 and T3 of the past time division channel i–2, which is two time division channels before the present time division channel i.

In FIG. 3, the half adder 33 adds the integer portion of the F-number outputted by the F-number generator 30 with the carry data of the fractional portion of the waveform address which is to be updated. The half adder 33 supplies the added result as the address step data ΔI to a delay circuit 40. The value of the address step data ΔI is limited within [4]. The delay time of the delay circuit 40 is controlled based on the external device designating signal OP. The address step data ΔI is supplied to an increment signal generating section 41 and to a back step data generating section 42 via the delay circuit 40 at a predetermined timing. The role of the delay circuit 40 is to control the output timing of the address step data ΔI regardless to the existence of the external device so that the address step data ΔI is outputted when the integer portion of the waveform address is read out from the address RAM 38 and is latched by the latch 45.

The increment signal generating section 41 generates increment signals INC1, INC2, INC3 and INC4 which constitute four bits serial data. The increment signals INC1 to INC4 are sequentially supplied to a decoding circuit 64 which is provided in each external device. The increment signals INC1 to INC4 designate the number of the compressed waveform data which are to be decoded to the non-compressed waveform data by the decoding circuit 64. The decoding operation of the decoding circuit 64 is controlled based on the increment signals INC1 to INC4. The values of the increment signals INC1 to INC4 are determined based on the address step data ΔI as follows:

| ΔI | INC1 | INC2 | INC3 | INC4 |
|---|---|---|---|---|
| 0 | 0 | 0 | 0 | 0 |
| 1 | 1 | 0 | 0 | 0 |
| 2 | 1 | 1 | 0 | 0 |
| 3 | 1 | 1 | 1 | 0 |
| 4 | 1 | 1 | 1 | 1 |

When regenerating non-compressed waveform data, the function of the external device *7a* or *7b* for decoding compressed waveform data is not necessary. In this case, the external device *7a* or *7b* provides a buffer function for storing the waveform data which has been regenerated from the waveform memory 6 and are used for the interpolation. The buffer function of the external device is used in one of the following conditions:

<Condition-1>

Two tone generating sections are used (the double chip signal C2 has the value [1]).

<Condition-2>

The external device *7a* or *7b* is used (the external device designating signal OP is not [0]).

<Condition-3>

The four points interpolation is selected (the interpolation control signal P2 is [0]).

In these conditions, the address step data ΔI and the increment signals INC1 to INC4 are generated in the same manner as to the case in which the compressed waveform data are regenerated.

The back step data generating section 42 multiplies the address step data Δ by [−1]. and adds the multiplied result −ΔI with [1]. and supplies the added result −ΔI+1 to a selector 43. The address step data ΔI is limited within [4]. Therefore, the back step data generating section 42 outputs the back step data having the one of the values [1], [0], [−1], [−2] and [−3]. The selector 43 receives fixed values [−3] and [−2] except for the back step data. The selector 43 selects one from the back step data outputted by the back step data generating section 42 and fixed values [2] and [−3] based on the interpolation control signal P2 and the double chip signal C2. The data selected by the selector 43 is supplied to a bit extending section 44.

The back step data outputted by the back step data generating section 42 is selected by the selector 43 when the function of the external device 7 is used. That is to say, the back step data is selected in one of the following conditions:

<Condition-1>

The external device 7*a* or 7*b* is used (i.e.. the external device designating signal OP is not [0]) and compressed waveform data are regenerated (i.e., the compression control signal COMP is [1]) during the present time division channel.

<Condition-2>

The tone generating chips 8*an* and 8*b* are used (.i.e., the double chip signal C2 is [1]) and the external device 7*a* or 7*b* is used (i.e., the external device designating signal OP is not [0]) and four points interpolation is selected as the interpolation method (the interpolation control signal P2 is [0]) during the present time division channel.

The address step data ΔI indicates the difference between the integer portion of the present waveform address latched by the latch 45 and the integer portion of the past waveform address. More specifically, the present waveform address has been updated during the past time division channel i−4 which is four time division channels before the present time division channel, and the present waveform address thus updated is latched by the latch 45. The address step data ΔI Indicates the increased value of the integer portion of the waveform address which is generated by the waveform address update operation during the past time division channel i−4.

The back step data has the value of {(−11)*ΔI+i}. That is to say, the back step data has a minus value and the absolute value of the back step data is less than the address step data Δ by one.

The other input values [−2] and [−3] are selected by the selector 7 when the function of the external device 7*a* or 7*b* is not used (i.e., the cases except for the above cases a and b). More specifically, the value [−2] is selected when the two points interpolation is carried out during the present time division channel (i.e., the interpolation control signal P2 is [1]). The value [−3] is selected when the four points interpolation is carried out during the present time division channel (i.e., the interpolation control signal P2 is [0]).

The integer portion of the waveform address latched by the latch 45 designates the last waveform data of the waveform data to be used for interpolation.

Next, the storing form of the waveform data in the waveform memory 6 will be described.

In this embodiment, non-compressed waveform data or compressed waveform data are stored in the waveform memory 6. The non-compressed waveform data are obtained by sampling the waveform at a predetermined sampling frequency and by coding the sample data. The non-compressed waveform data have 16-bit length. In contrast, when waveform data having a large information quantity are recorded to the waveform memory 6, the waveform data are compressed by LPC coding. Furthermore, the data obtained by the LPC coding are converted to logarithmic form (i.e., Linear to Log conversion is carried out). As a result, compressed waveform data, each one consisting of 8 bits, are obtained. In this preferred embodiment, the compressed waveform data thus obtained are stored in the waveform memory 6.

The waveform memory 6 inputs or outputs data having 16-bit length. Each memory area of the waveform memory 6 can store 16 bit.

Therefore, when storing non-compressed waveform data, one waveform data is stored in each memory areas of the waveform memory 6.

Figure 6:
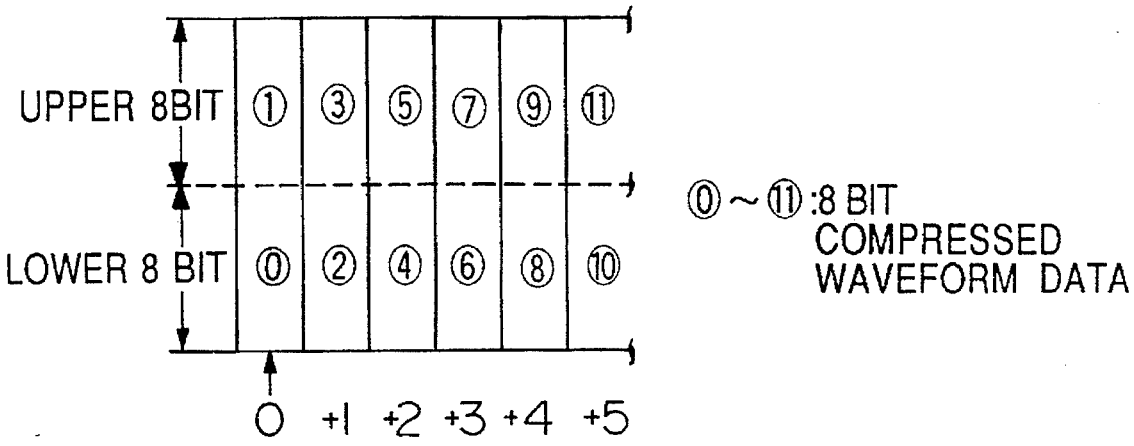
FIG. 6 is the memory map of an waveform memory provided in the electronic musical instrument shown in FIG. 1.

In contrast, when storing the compressed waveform data, a series of compressed waveform data are stored in the waveform memory 6 as shown in FIG. 6. That is to say, the 0th compressed waveform data ⓪ is stored in the lower 8 bit area of the address 0. The first compressed waveform data ① is stored in the upper 8 bit area of the address 0. The second compressed waveform data ② is stored in the lower 8 bit area of the address 1. In this manner, the 16 bit data, each one of which consists of successive compressed waveform data corresponding to an even sequence number and an odd sequence number, are stored in the memory areas of the waveform memory 6.

Next, the description will be given with respect to the regeneration of the waveform data.

a. Regeneration of Compressed Waveform Data

When generating musical tones based on the compressed waveform data stored in the waveform memory 6, the compressed waveform data are sequentially read out from the waveform memory 6 at a rate which is determined based on the tone pitch of the musical tone to be generated. The compressed waveform data thus read out are sequentially decoded to non-compressed waveform data based on the past non-compressed data which have been previously obtained by the decoding operation. The sample data of the musical tone waveform to be regenerated are sequentially interpolated using the non-compressed waveform data thus decoded.

As described above, the decoding operation for the compressed waveform data requires the past non-compressed waveform data which have been previously decoded. In this embodiment, the latch 6 latches the waveform address of the last one of the waveform addresses of the waveform data which have been previously read out from the waveform memory 6. When the sampling period is changed to new one and the waveform address latched by the latch 6 is updated, the compressed waveform data corresponding to the updated waveform address should be read out from the waveform memory 6 and the compressed waveform data thus read out should be decoded to non-compressed waveform data.

In this decoding operation, there are cases in which a plurality of compressed waveform data should be read out from the waveform memory 6.

For example, suppose that non-compressed waveform data $W_{-3}$, $W_{-2}$, $W_{-1}$, $W_0$ have been previously obtained though the decoding operation and the waveform address $A_0$ which designates the compressed waveform data $CW_0$ corresponding to the last non-compressed waveform data $W_0$ is stored in the address RAM 38. If the waveform address is increased to $A_3$ during the next sampling period, it is necessary to read out not only the compressed waveform data $CW_3$ corresponding to the updated waveform address $A_3$ but also the past compressed waveform data $CW_1$, $CW_2$ corresponding to intermediate addresses $A_1$, $A_2$ between the last waveform address $A_0$ and the updated waveform address $A_3$. Because, the compressed waveform data $CW_1$ is necessary to obtain the non-compressed waveform data $W_1$ based on the non-compressed waveform data $W_0$, and the compressed waveform data $CW_2$ is necessary to obtain the non-compressed waveform data $W_2$ based on the non-compressed waveform data $W_1$.

In order to read out such non-compressed waveform data, the following operation is carried out based on the address step data ΔI which is outputted by the half adder 33. This address step data ΔI indicates the increased value between the waveform address at the last sampling period and the waveform address at the present sampling period. The increment signal generating section 41 generates the increment signal INC (INC1 to INC4) consisting of one or more pulses, the number of which indicates the number of the non-compressed waveform data to be read out from the waveform memory 6 and is determined based on the address step data ΔI, as described above. The back step data generating section 42 calculates {(−1)*ΔI+1} and generates the calculated result as the back step data. The back step data is added with the waveform address latched in the latch 45 by the adder 47. The adder 47 outputs the waveform address which is earlier than the present waveform address (the waveform address latched In the latch 45) by the back step data.

b. Regeneration of Non-Compressed Waveform Data By Using Four Points Interpolation When non-compressed waveform data are read out from the waveform memory 6 and the non-compressed waveform data thus read out are interpolated by four points interpolation, the value [−3] is selected by the selector 43. The output data of the adder 47 is used as a read address which designates the first waveform data of the four waveform data to be used for the interpolation. An interpolation counter 49 and an adder 50 are provided for increasing the read out address to sequentially read out the first, the second, the third and the fourth waveform data. The data [0], [1], [2] and [3] are sequentially outputted from the interpolation counter 49 in synchronization with the changing of time slot. Therefore, the data [−3], [−2], [−1] and [0] are sequentially outputted from the adder 47 and are used for sequentially reading out the four waveform data to be used for the four points interpolation.

In the four points interpolation, a waveform data, which exists between the second waveform data and the third waveform data and corresponds to the fractional portion of the waveform address is determined.

c. Regeneration of Non-Compressed Waveform Data By Using Two Points Interpolation When non-compressed waveform data are read out from the waveform memory 6 and the non-compressed waveform data thus read out are interpolated by two points interpolation (i.e., linear interpolation), the value [−2] is selected by the selector 43. The data [0] and [1] are sequentially outputted from the interpolation counter 49 in synchronization with the changing of time slot. Therefore, the data [−2] and [−1] are sequentially outputted from the adder 47 and are used for sequentially reading out the four waveform data to be used for the two points interpolation.

In the two points Interpolation, a waveform data, which exists between the first waveform data and the second waveform data and corresponds to the fractional portion of the waveform address is determined. On the other word, the two waveform data used for the two points interpolation respectively correspond to the second and the third waveform data of the four waveform data used for the four points interpolation. Thus, waveform data having a same phase angle are interpolated regardless to the order of the interpolation. That is to say, when the two points interpolation and the four points Interpolation are simultaneously carried out based on the same waveform data, two waveform having a same phase angle are simultaneously obtained. There are cases in which two waveforms are regenerated and the waveforms thus regenerated are mixed. In these cases, if the phase angle between the two waveforms are changed by changing the order of the interpolation, the tone color of the mixed waveform is changed due to the change of the phase angle between the two waveforms. But, the phase angle of the regenerated waveform is not changed although the order of the interpolation is changed in this preferred embodiment. Therefore, such a disadvantage does not appear.

An extending section 44 converts the output data of the selector 43 to 16 bit data. The output data of the extending section 44 is supplied to adder 47.

The integer portion of the waveform address outputted by the adder 47 is supplied to a shift down section 48. The least significant bit of the integer portion of the waveform address is supplied to the external device as the signal ODD. When a 16 bits data is read out from the waveform memory 6, the upper 8 bits or the lower 8 bits is selected based on the signal ODD. The shift down section 48 shifts the bits of the waveform address by one bit in a lower direction and supplies the shifted waveform address to an adder 50 when the value of the compression control signal COMP is [1]. That is to say, when the compression signal COMP is [1], the integer portion of the waveform address is divided by two.

The interpolation counter 49 has the role for controlling the waveform address to sequentially read out the waveform data to be used for the interpolation. When one chip of the waveform generating section **8*a* is used for the tone generation, the four data [0], [1], [2] and [3] are sequentially outputted by the Interpolation counter 49 during four time slots which constitute one time division channel. When the tone generating chips 8*a* and 8*b* are used for tone generation, the four data [0], [1], [0] and [1] are sequentially outputted by the interpolation counter 49 during the four time slots. The four data thus outputted are sequentially supplied to the adder 50**.

The adder 50 totals the waveform address outputted by the shift down section 48, the start address TADDC and the output data of the Interpolation counter 49. The start address TADDC is a memory address of the waveform memory 6 at which the leading waveform data of the waveform is stored.

When one chip of the tone generating section **8*a* is used for the tone generation, the four memory address data, which designate the successive four memory locations of the waveform memory 6 at which the four waveform data data to be used for the four points interpolation are stored, are sequentially outputted by the adder 50. On the other hand, when two chips of the tone generating section 8*a* and 8*b* are used for the tone generation, the two memory address data, which designate the successive two memory locations of the waveform memory 6** at which the two waveform data data to be used for the two points interpolation are stored, are sequentially outputted by the adder 50 twice.

The memory address data thus outputted are sequentially supplied to a gate circuit 51. The output data of the gate circuit 51 is supplied to the waveform memory 6 as the read out address. The gate circuit 51 controls the output timing of the read out address.

More specifically, when one chip of the tone generating section is used for the tone generation, the gate circuit 51 is always on-state. Therefore, all of the four memory address data are transmitted to the waveform memory 6 through the gate circuit 51.

In contrast, when two chips of the tone generating sections are used for the tone generation, the gate circuit 50 is on-state during the first half of the time division channel or during the latter half of the time division channel first. If this tone generating chip is the master tone generating section and receives the master signal MC having the value of [1], the gate circuit 51 is on-state only during the first half of the time division channel (i.e., the first and second time slots). Therefore, the two memory address data are supplied by this tone generating section (i.e., the master tone generating section) to the waveform memory 6 during the first half of the time division channel. On the other hand, if this tone generating section is the slave tone generating section and receives the master signal MC having the value of [0], the gate circuit 51 is on-state only during the latter half of the time division channel (i.e., the third and fourth time slots). Therefore, the two memory address data are supplied by this tone generating section (the slave tone generating section) to the waveform memory 6 during the first latter of the time division channel.

In this manner, the read out address are supplied to the waveform memory 6. As a result, the waveform data to be used for the interpolation are read out from the waveform memory 6. The waveform data thus read out are sequentially supplied to the external device 7.

(5) Configuration of External Device *7a* and *7b*

Figure 5:
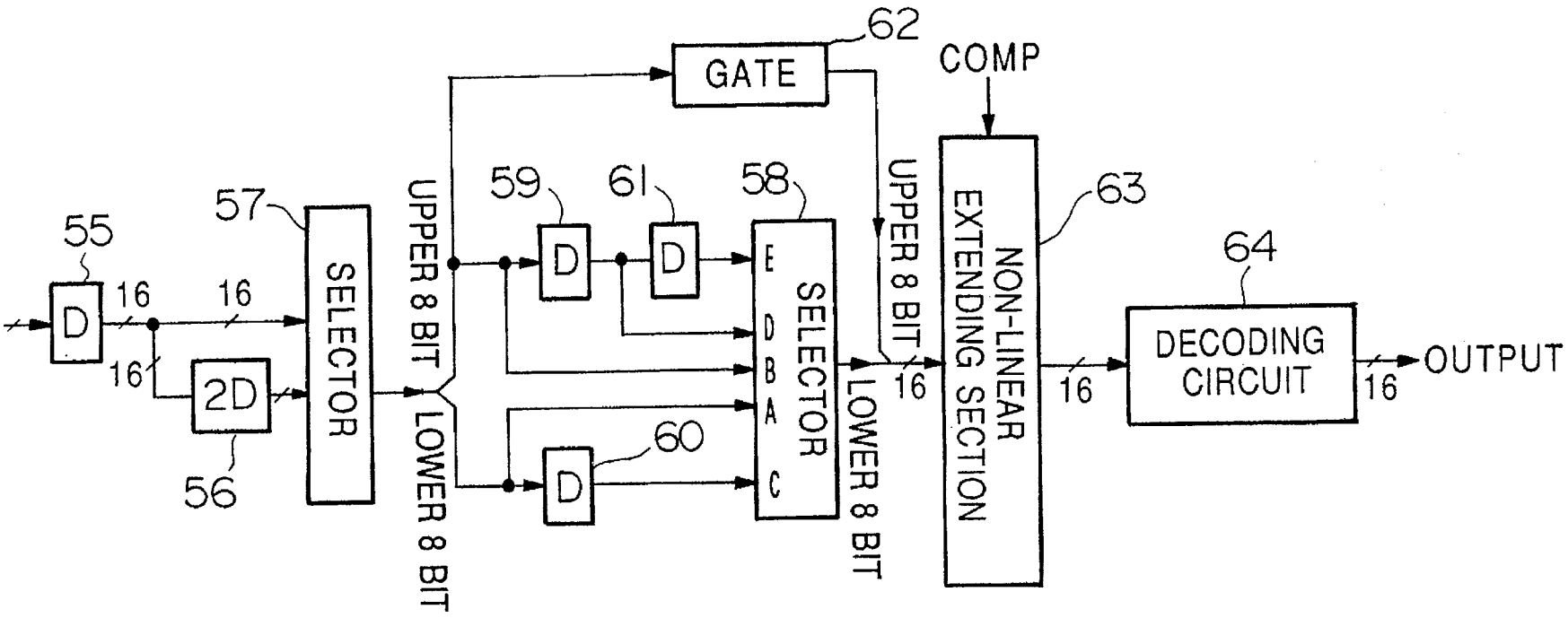
FIG. 5 is a block diagram showing the configuration of the external device of the electronic musical instrument shown in FIG. 1.

FIG. 5 is a block diagram showing the configuration of the external device *7a* or *7b*. In the drawing, 55 designates a delay circuit which delays the waveform data (16 bits data) read out from the waveform memory 6 by one time slot. The delay circuit 55 supplies the delayed waveform data to a delay circuit 56 and to one of the two input terminals of a selector 57. The delay circuit 56 delays the waveform data outputted by the delay circuit 55 by two time slots and supplies the delayed data to the another input terminal of the selector 57.

When one chip of the tone generating section is used for the tone generation, the selector 57 of the external device selects the output data of the delay circuit 56, i.e., the data which is obtained by delaying the waveform data read out from the waveform memory 6 by three time slots.

In contrast, when the master and the slave tone generating sections 8*a* and 8*b* are used for the tone generation and the external devices *7a* and *7b* respectively operate for the tone generating sections 8*a* and 8*b*, the master tone generating section 8*a* and the external device *7a* need the two waveform data I and II which are read out from the waveform memory during the first half of the time division channel. On the other hand, the slave tone generating section 8*b* and the external device *7b* need the two waveform data III and IV which are read out from the waveform memory 6 during the latter half of the time division channel. Therefore, the selector 57 of the external device *7a* selects the output data of the delay circuit 56, i.e., the data which is obtained by delaying the waveform data read out from the waveform memory 6 by three time slots. On the other hand, the selector 57 of the external device *7b*, which corresponds to the slave tone generating section 8*a*, selects the output data of the delay circuit 55, i.e., the data which is obtained by delaying the waveform data read out from the waveform memory 6 by one time slot.

58 designates a selector which has four data input terminals A, B, C, D and E. 59, 60 and 61 designate delay circuits, each one of which delays the input data by one time slot. The upper 8 bit data of the output data of the selector 57 is delayed by the delay circuits 59 and 61. The lower 8 bit data of the output data of the selector 57 is delayed by the delay circuit 60. The delay circuit 59 delays the upper 8 bit data by one time slot. The delay circuit 61 delays the output data of the delay circuit 59. The selector 58 selects one from the following input data which are supplied to the input terminals A to E.

A. the lower 8 bit data
B. the upper 8 bit data
C. the output data of the delay circuit 60 (the lower 8 bit data delayed by one time slot)
D. the output data of the delay circuit 59 (the upper 8 bit data delayed by one time slot)
E. the output data of the delay circuit 61 (the upper 8 bit data delayed by two time slots)

Figure 7A:
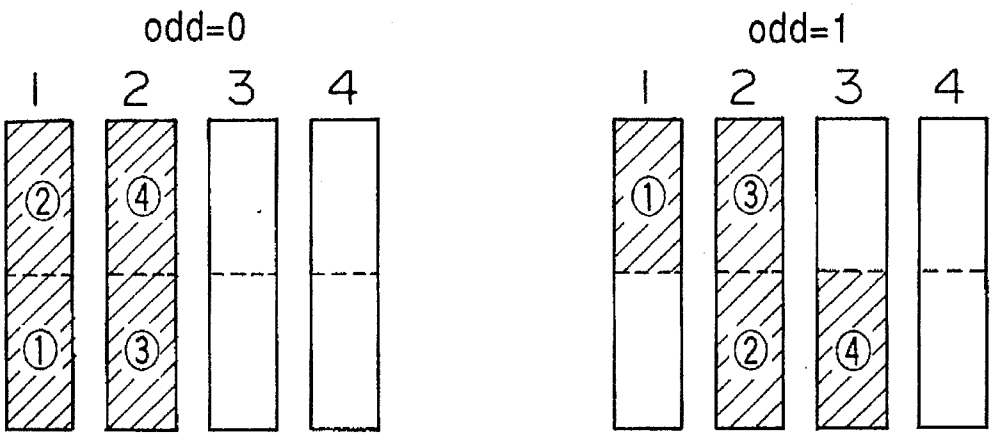
FIGS. 7A to 7C show operations for reading out waveform data from the waveform memory.

The detailed description will be given with respect to the selecting operation of the selector 58 with reference to FIGS. 7A to 7C. In FIG. 7A, ①, ②, ③ and ④ designate 8 bit compressed waveform data which are to be decoded to the non-compressed 16 bit waveform data during the present time division channel. There are two cases In the selecting operation of the selector 58. The signal ODD is set to [0] in the first case, and [1], the second case.

In the first case, the first and second compressed 8 bit data ① and ② are stored in the first memory location as the lower 8 bit data and the upper 8 bit data as illustrated in the left side in FIG. 7A. The third and fourth compressed 8 bit data ③ and ④ are stored in the second memory location as the lower 8 bit data and the upper 8 bit data.

Figure 7B:
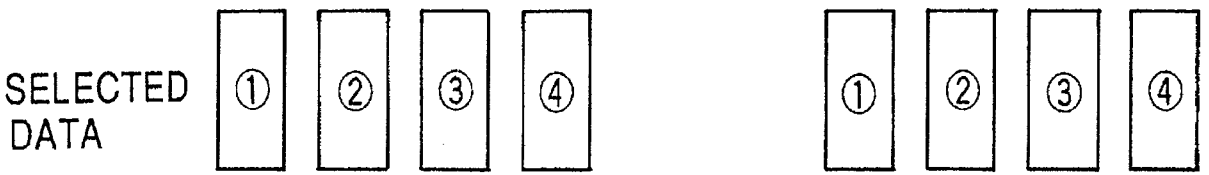
Figure 7C:
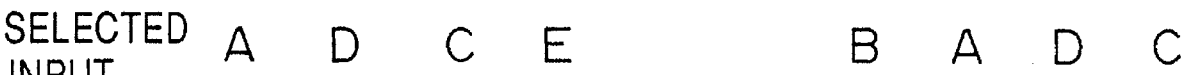

In this case, the selector 58 sequentially selects the input terminals A, D, C and E in synchronization with the changing of the time slot as shown in FIG. 7C.

Therefore, the following data are selected by the selector 58 during the first to fourth time slots.

| time slot | the output data of the selector 58 |
|---|---|
| 1 | the lower 8 bit data (i.e., the compressed waveform data ①) |
| 2 | the output data of the delay circuit 59 (i.e., the compressed waveform data ②) |
| 3 | the output data of the delay circuit 60 (i.e., the compressed waveform data ③) |
| 4 | the output data of the delay circuit 61 (i.e., the compressed waveform data ④) |

As a result, the compressed waveform data ①, ②, ③ and ④ are sequentially obtained from the selector 58 during the first to fourth time slots as show in the left side in FIG. 7B.

In the second case, the first compressed 8 bit data ① is stored in the first memory location as the upper 8 bit data as illustrated in the right side in FIG. 7A. The second and third compressed 8 bit data ② and ③ are stored in the second memory location as the lower 8 bit data and the upper 8 bit data. The fourth compressed 8 bit data ④ is stored in the third memory location as the lower 8 bit data.

In this case, the selector 58 sequentially selects the input terminals B, A, D and C in synchronization with the changing of the time slot as shown in FIG. 7C.

Therefore, the following data are selected by the selector 58 during the first to fourth time slots.

| time slot | the output data of the selector 58 |
|---|---|
| 1 | the upper 8 bit data (i.e., the compressed waveform data ①) |
| 2 | the lower 8 bit data (I. e. . the compressed waveform data ②) |
| 3 | the output data of the delay circuit 59 (i.e., the compressed waveform data ③) |
| 4 | the.output data of the delay circuit 60 (i.e., the compressed waveform data ④) |

As a result, the compressed waveform data ①, ②, ③ and ④ are sequentially obtained from the selector 58 during the first to fourth time slots as show in the left side in FIG. 7B.

The compressed waveform data outputted by the selector 58 are sequentially supplied to a non-linear extending section 63.

62 designates a gate circuit. The upper 8 bit data of the output data of the selector 57 is supplied to the gate circuit 62. When non-compressed waveform data (16 bit data) is read out from the waveform memory 6, the gate circuit 62 is on-state and the selector 58 selects the lower 8 bit data of the output data of the selector 57. Therefore, the upper 8 bit and lower 8 bit of the output data of the selector 57 are supplied to the non-linear extending section 63.

The non-linear extending section 63 is a circuit which decodes the 8 bit compressed waveform data to the 16 bit non-compressed waveform data. When the compression control signal COMP is [1] and the compressed waveform data are supplied to the non-linear extending section 63, the non-linear extending section 63 carries out log/linear conversion on the compressed waveform data and extends the bit length of the linear compressed waveform data to 16 bit. On the other hand, when the compression control signal COMP is [0] and the non-compressed waveform data are supplied to the non-linear extending section 63, the non-linear extending section 63 directly outputs the non-compressed waveform data.

(6) Configuration of Decoding Section 64

Figure 8:
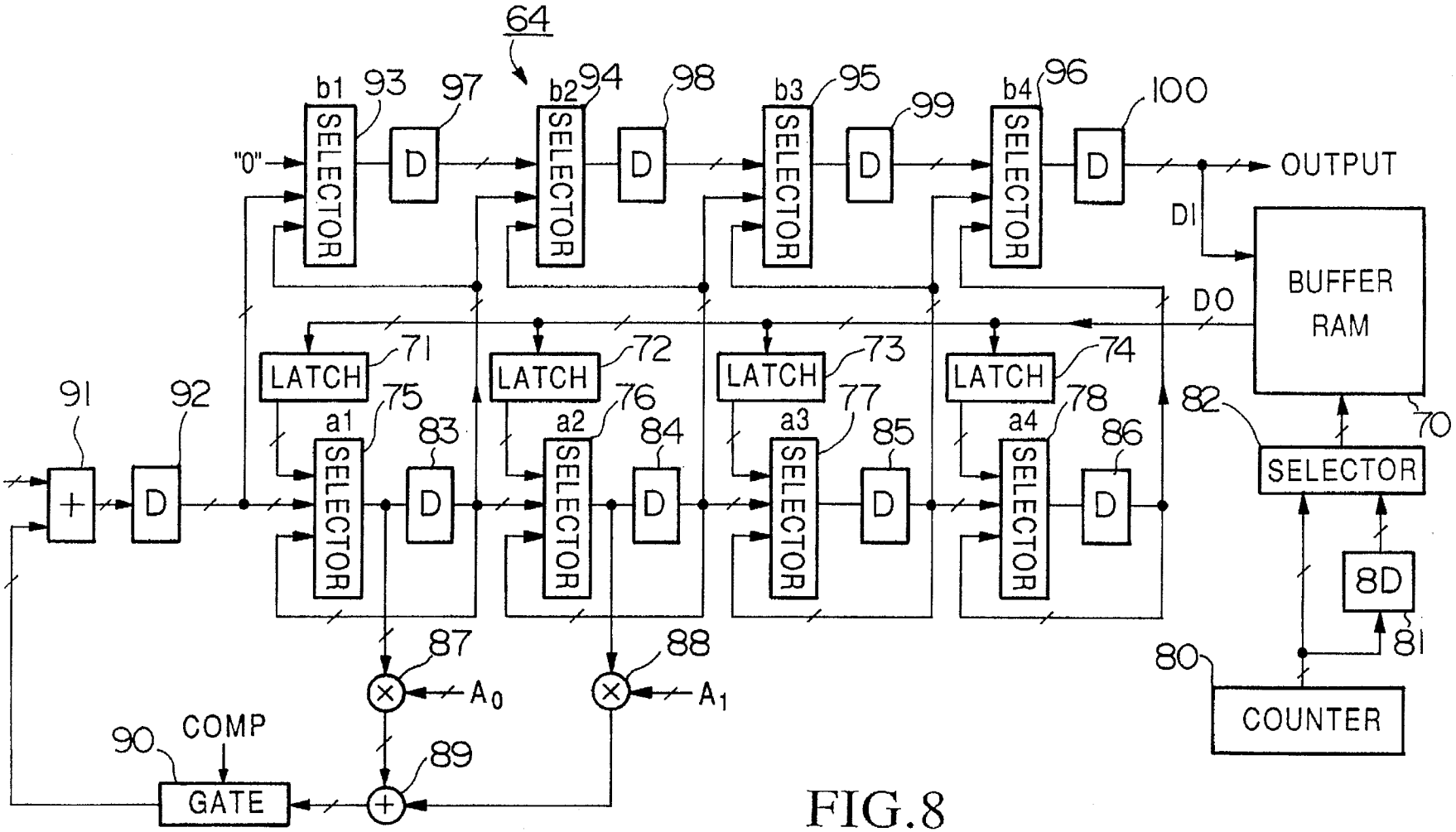
FIG. 8 is a block diagram showing the configuration of a decoding circuit provided in the external device.

FIG. 8 is a block diagram showing the configuration of the decoding section 64. 70 designates a buffer RAM for storing past non-compressed waveform data. If a non-compressed waveform data is obtained through the decoding operation of this decoding section, the non-compressed waveform data thus obtained is stored in the buffer RAM 70 via the input terminal DI. In this decoding section, four non-compressed waveform data are obtained for one time division channel.

The non-compressed waveform data thus stored are read out from the buffer RAM via the output terminal DO and the non-compressed waveform data thus read out are supplied to latches 71, 72, 73 and 74 to be used for the decoding operation. More specifically, past non-compressed waveform data, which have been obtained during the past sampling period are read out from the buffer RAM 70 and are latched by the latches 71 to 74. The latch 71 stores the past non-compressed waveform data which has been obtained one sampling period ago. The latch 72 stores the past non-compressed waveform data which has been obtained two sampling periods ago. The latch 73 stores the past non-compressed waveform data which has been obtained three sampling periods ago. The latch 74 stores the past non-compressed waveform data which has been obtained four sampling periods ago.

A channel counter 80, a delay circuit 81 and a selector 82 constitute a circuit for generating the read out address and the write address and for supplying them to the buffer RAM 70. The channel counter 80 sequentially outputs the data [1], [2] . . . . which designate the channel number of the present time division channel. The data thus outputted are sequentially supplied to one of the input terminals of the selector 82 and to the delay circuit 81. The delay circuit 81 delays the output data of the channel counter 80 by eight time slots (i.e., two time division channels) and supplies the data thus delayed to the other input terminal of the selector 82. The output data of the channel counter 81 directly supplied to the selector 82 are supplied to the buffer RAM 70 as the read out address. On the other hand, the output data, of the channel counter supplied to the selector via the delay circuit 81 are supplied to the buffer RAM 70 as the write address.

75 to 78 designate selectors which have three input terminals. 83 to 86 designate delay circuits which respectively delay the output data of the selectors 75 to 78. The selectors 75 to 78 are connected in cascade via the delay circuits 83 to 85.

The output data of the selectors 75 and 76 are respectively supplied to multipliers 87 and 88. LPC decoding coefficients $A_0$ and $A_1$ are respectively supplied to the multipliers 87 and 88. The multipliers 87 multiplies the output data of the selector 75 by the LPC coefficient $A_0$ while the multiplier 88 multiplies the output data of the selector 76 by the LPC coefficient $A_1$. An adder 89 adds the multiplied results of the multipliers 87 and 88 and supplies the added result to a gate circuit 90 as a predicted data.

The output terminal of the gate circuit 90 is connected to one of the input terminal of an adder 91. The other input terminal of the adder 91 receives the compressed waveform data which is supplied from the above-described non-linear extending section 63. The output data of the adder 92 is delayed by a delay circuit 92.

When the compression control signal COMP is [1], the gate circuit 90 is on-state and the predicted data is supplied one of the input terminals of the adder 91. The adder 91 adds the predicted data with the compressed waveform data (residual data) and supplies the added result to the delay circuit 92. The delay circuit 92 delays the output data of the adder 91 by one time slot. The output data of the delay circuits 92, 83, 84 and 85 are respectively supplied to the second input terminals of the selectors 75, 76, 77 and 78. Furthermore, the output data of the delay circuits 83, 84, 85 and 86 are respectively supplied to the third input terminals of the selectors 75, 76, 77 and 78. The output data of the latches 71. 72, 73 and 74 are respectively supplied to the first input terminals of the selectors 75, 76, 77 and 78. The selectors 75 to 78 select one of the three input data in response to the above-described increment signals INC1, INC2 and INC3 and supply the selected data to the delay circuits 83 to 86.

93 to 96 designate selectors which have three input terminals. 97 to 100 designate delay circuits which respectively delay the output data of the selectors 93 to 96. The selectors 93 to 96 are connected in cascade via the delay circuits 97 to 99. The fixed value [0] is supplied to the first input terminal of the selector 93. The output data of the delay circuits 97 to 99 are respectively supplied to the first input terminals of the selectors 94 to 96. The output data of the delay circuits 92, 83, 84 and 85 are respectively supplied to the second input terminals of the selectors 93 to 96. The output data of the delay circuits 83, 84, 85, 86 are respectively supplied to the third input terminals of the selectors 93 to 96. The selectors 93 to 96 select one of the three input data in response to the above-described increment signal INC4 and supply the selected data to the delay circuits 97 to 100.

The output data of the last stage delay circuit 100 is outputted as a decoded data, i.e., a non-compressed waveform data. The non-compressed waveform data thus obtained is supplied to the interpolating section 19 and to the buffer RAM 70 as mentioned above.

(7) Configuration of Interpolating Section 19

Figure 9:
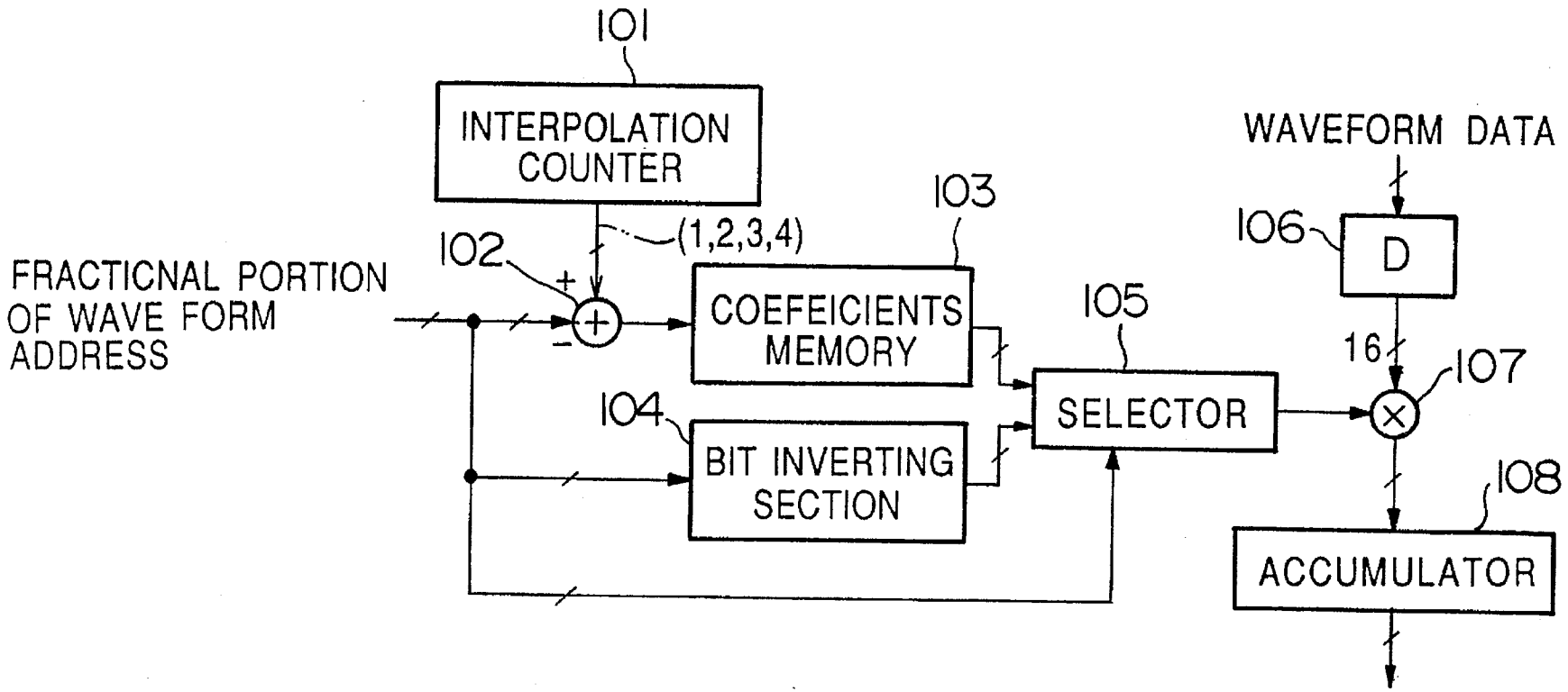
FIG. 9 is a block diagram showing the configuration of an interpolating section of the electronic musical instrument shown in FIG. 1.

FIG. 9 is a block diagram showing the configuration of the interpolating section 19. In FIG. 9, 101 designates an interpolation counter. 102 designates a subtractor. 103 designates a coefficient memory which stores interpolation coefficients. 104 designates a bit Inverting section. 105 designates a selector. 106 designates a delay circuit. 108 designates a multiplier. 108 designates an accumulator.

The fractional portion FRAC of the waveform address, which is generated by the address generating section 18, is supplied to one of the input terminals of the subtractor 102, and to the bit inverting section 104, and to the third input terminal of the selector 105. The interpolation counter 101 sequentially outputs recurring numbers [1], [2], [3], [4], [1], . . . . The output data of the interpolation counter 101 is supplied to the other input terminal of the subtractor 102. The data [1] to [4], which are outputted by the interpolation counter 101, are sequentially supplied to the subtractor 102 in synchronization with the supply of the four waveform data which are to be used for the interpolation. The subtractor 102 sequentially outputs 1-FRAC, 2-FRAC, 3-FRAC and 4-FRAC.

Figure 10A:
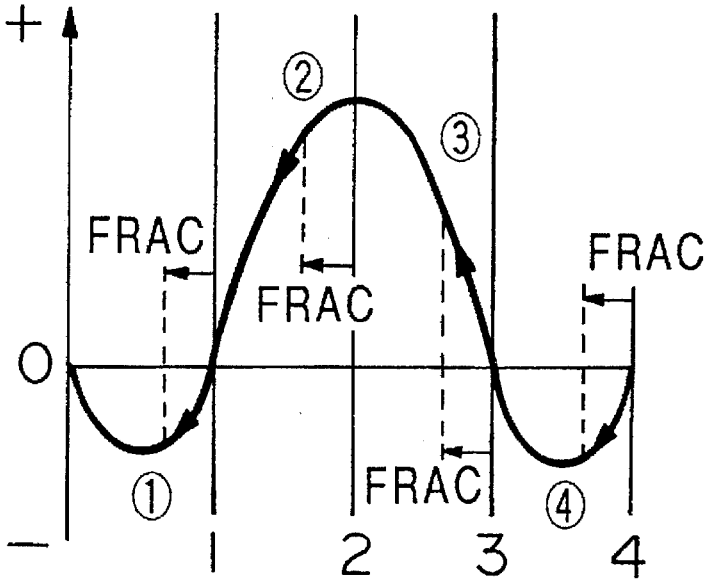
FIGS. 10A and 10B show interpolation methods used in the preferred embodiment.

The coefficients memory 103 stores interpolation coefficients which constitute a function as shown in FIG. 10A. The coefficients memory 103 sequentially outputs the interpolation coefficients corresponding to 1-FRAC, 2-FRAC, 3-FRAC and 4-FRAC.

When the interpolation signal P2 is [0] and the four points interpolation is to be carried out, the interpolation coefficients outputted by the coefficients memory 103 are selected by the selector 105. The Interpolation coefficients thus selected, which correspond to 1-FRAC, 2-FRAC, 3-FRAC and 4-FRAC are sequentially supplied to the multiplier 107.

On the other hand, the waveform data ①, ②, ③ and ④ (non-compressed waveform data), which are to be interpolated and correspond to [1], [2], [3] and [4], are sequentially supplied to the multiplier 107 from the decoding section 64 via the delay circuit 106. As a result, the four products, i.e., the first product of the waveform data ① and the coefficient corresponding to 1-FRAC, the second product of the waveform data ② and the coefficient corresponding to 2-FRAC, the third product of the waveform data ③ and the coefficient corresponding to 3-FRAC and the fourth product of the waveform data ④ and the coefficient corresponding to 4-FRAC are sequentially outputted by the multiplier 107. The products thus outputted are accumulated by the accumulator. As a result, the Interpolated waveform data corresponding to the fractional portion FRAC of the waveform address is obtained from the accumulator 108.

The bit inverting section 104 outputs the complement data of the data FRAC having bits which are obtained by inverting the all bits of FRAC. The output data of the inverting section 104 has the value of 1-FRAC.

When the interpolation control signal P2 is [1] and the two points interpolation is to be carried out, the fractional portion FRAC of the waveform address and the data 1-FRAC outputted by the bit inverting section 104 are used for the interpolation.

Figure 10B:
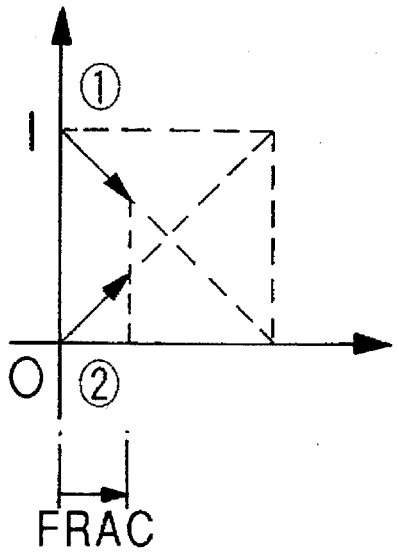

More specifically, if this interpolating section is provided in the master tone generating section 8*a* and the master signal MC having the value of [1] is supplied to the interpolating section, the two waveform data, which are to be used for the two points interpolation, are sequentially supplied to the interpolating section during the first half of the time division channel. If this interpolating section is provided in the slave tone generating section 8*b* and the master signal MC having the value of [0] is supplied to the interpolating section, the two waveform data, which are to be used for the two points Interpolation, are sequentially supplied to the interpolating section during the latter half of the time division channel. In order to supply the coefficients corresponding to these waveform data, the selector 105 sequentially selects 1-FRAC and FRAC during the first half of the time division channel and during the latter half of the time division channel. FIG. 10B illustrates the waveform data and to be Interpolated and the coefficients 1-FRAC and FRAC which are multiplied to the waveform data.

(8) Operation of the preferred embodiment

Figure 11:
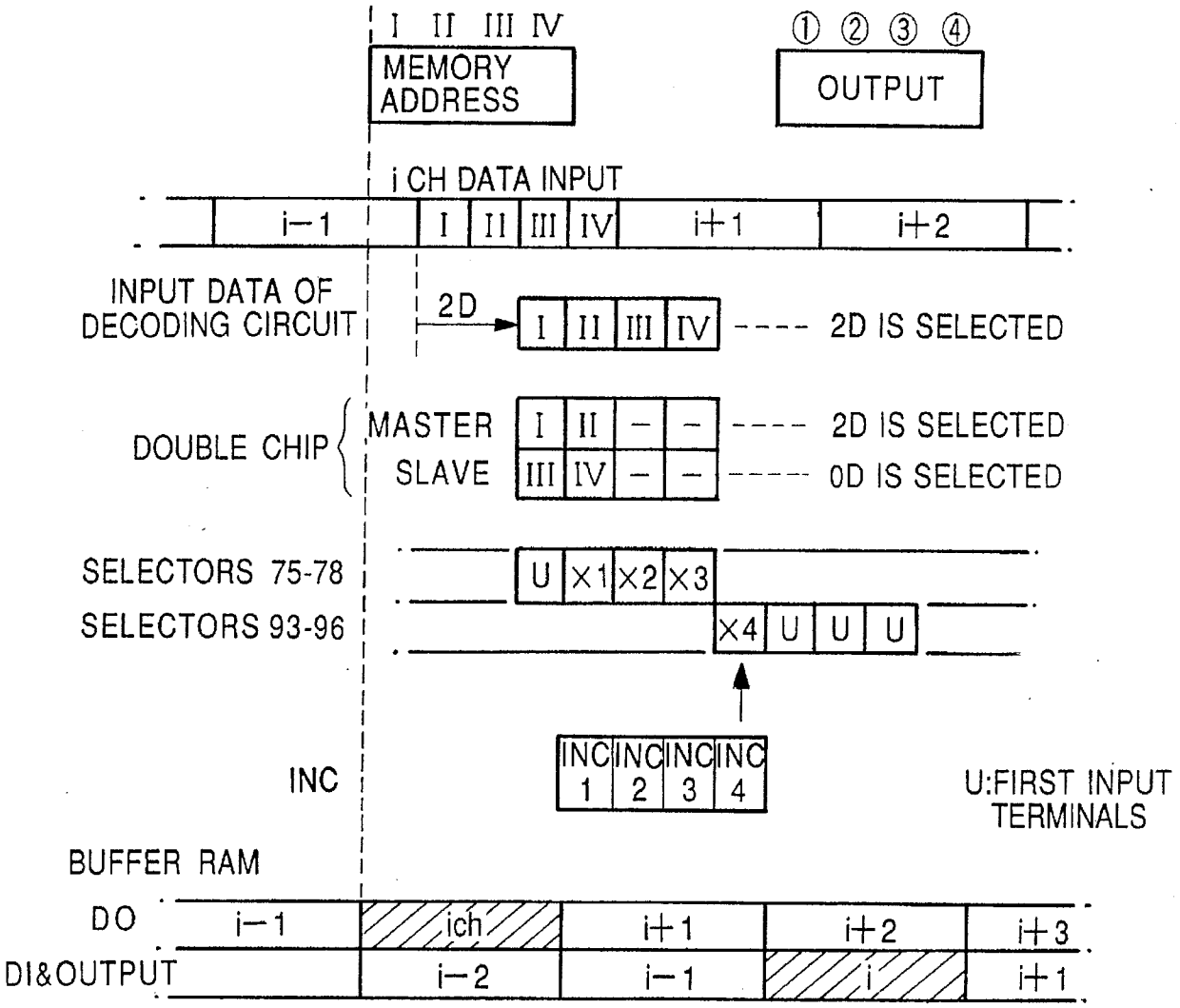
FIGS. 11 and 12 are time-charts showing the operation of the preferred embodiment.
Figure 12:
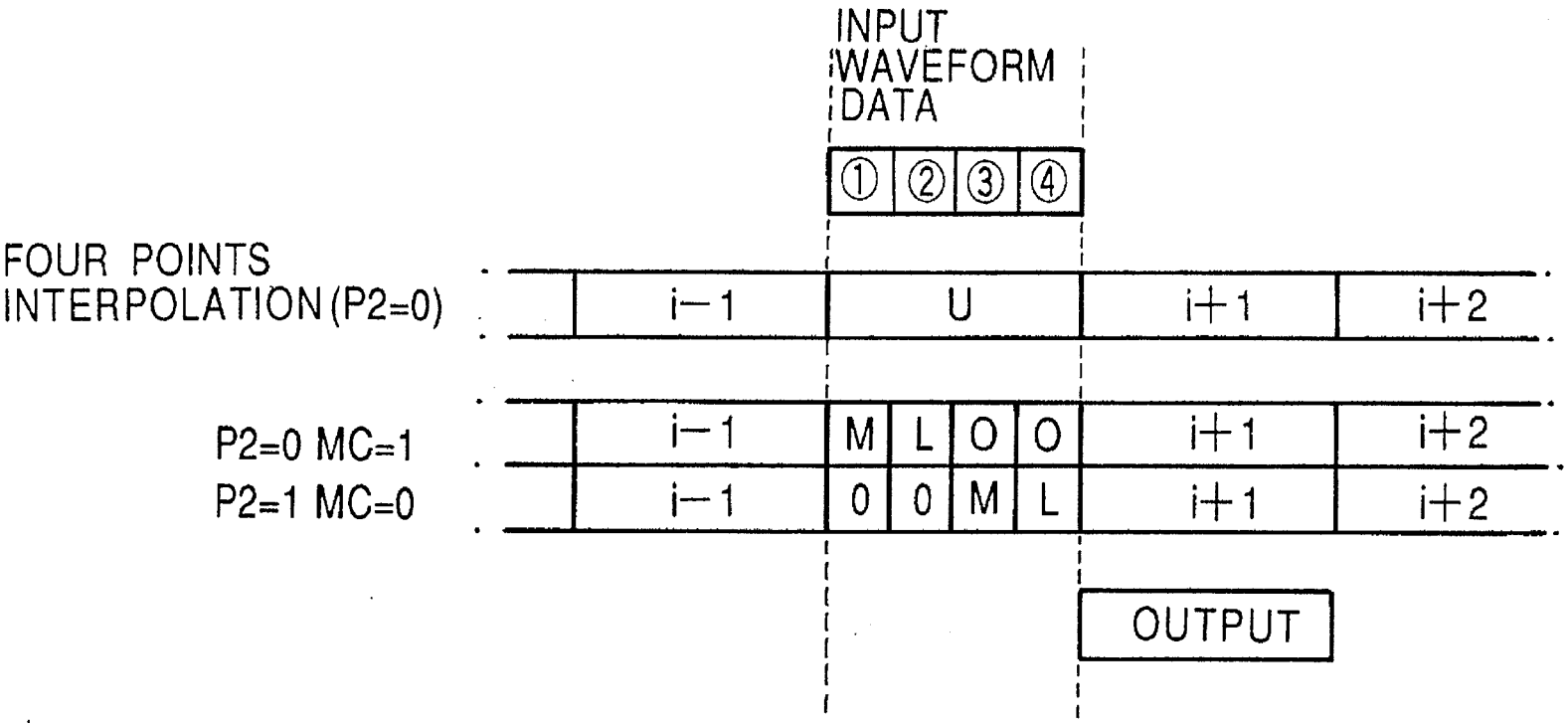

Next, the operation of the preferred embodiment is described with reference to time charts shown in FIGS. 11 and 12.

When the performer designates a tone color by operating the tone switch section 2 and performs by depressing keys of the keyboard 1, performance information Including the keycodes of the depressed keys and the key touch are supplied to the control section 3. As a result, performance control parameters such as note-on data and key-code are supplied to the register section 12 and the tone generating operation is carried.

As described above, various types of electronic musical instruments can be provided according to the present invention.

In the following the description will be given with respect to tone generating operations of the four types of the electronic musical instruments which employ the tone generating apparatus according to the present invention and the internal connection configurations are shown in FIGS. 2A to 2D.

(8-1) Case-A

The description will be given with respect to the operation of the first type of electronic musical instrument in which no external device is employed and one tone generating chip 8*a* is employed as tone generating section 8 as shown in FIG. 2A. In this case, the external device designating signal OP having the value [0], the double chip signal C2 having the value [0] and the master signal MC having the value [1] are generated. Musical tones are generated by using the four points Interpolation. The compressed waveform data stored in the waveform memory 6 are not used for tone generation. Thirty two time division channels may be used for tone generation. The non-compressed waveform data are used for the tone generation.

In this case, the external device designating signal OP having the value [0] is supplied to the offset generating section 36 of the address generating section 18. Therefore, the offset values [+4], [0], [0] and [+4] are respectively outputted during the time slots T1 to T4.

During the time slot T1, the offset value [+4] is generated by the offset generating section 36 as shown in FIG. 4. Therefore, the channel number of the present time division channel is added with [+4] by the full adder 37 and the added result is supplied to the address RAM 38. As a result, the waveform address data corresponding to the coming time division channel, which is latter than the present time division channel by four time division channels, is read out from the address RAM 38. The waveform address data thus read out is latched by the latch 39.

Next, during the time slots T2 and T3, the offset value remains the value [0]. Therefore, the waveform address data corresponding to the present time division channel is read out from the address RAM 38. The integer portion of the waveform address data thus read out is latched by the latch 45. The fractional portion of the waveform address data is latched by the latch 46. The waveform address data stored in the latch 39, which has been latched during the time slot T1, has the integer portion and the fractional portion. The integer portion of the waveform address data latched by the latch 39 is supplied to the full adder 31 and the fractional portion of the waveform address data is supplied to the full adder 32. On the other hand, the pitch data, which designates the tone pitch of the musical tone to be generated, is supplied to the F-number generating section 30. The F-number generating section 30 generates the F-number corresponding to the tone pitch of the musical tone based on the pitch data. The integer portion and the fractional portion of the F-number are respectively supplied to the full adders 31 and 32. As a result, the address data latched by the latch 39 is added with the F-number by the full adders 31 and 32. The new waveform address data, i.e., the added result obtained from the full adders 31 and 32 is supplied to the address control section 34. The modification for the loop regeneration is carried out on the new waveform address data by the address control section 34. The waveform address data thus modified is supplied to the data input terminal DI of the address RAM 38.

During the time slot T4, the offset value [+4] is generated by the offset generating section 36 as shown in FIG. 4. The channel number of the present time division channel is added with [+4] by the full adder 37 and the added result is supplied to the address RAM 38. The data write operation for the address RAM 38 is carried out during the time slot T4. Thus, the waveform address data supplied from the address control section 34 is written in the memory area of the address RAM 38 which corresponds to the coming time division channel which is latter than the present time division channel by four time division channels.

In this manner, the waveform address corresponding to the coming time division channel, which is four channels latter than the present time division channel, is updated by using the time slots T1 and T4 of the present time division channel. The waveform address data corresponding to the present time division channel is read out from the address RAM 38 and is latched by the latches 45 and 46 to be used for the tone generation.

In this case, the double chip signal C2 and the interpolation control signal P2 are [0]. Therefore, the value [−3] is selected by the selector 43 and is supplied to the adder 47 via the bit extending section 44. The adder 47 adds the integer portion of the waveform address INT supplied from the latch 45 with the value [−3] supplied from the selector 43 to adjust the integer portion of the waveform address so as to compensate the delay time of the waveform data read out operation. The added result INT-3 is supplied to the adder 50 via the shift down section 48. In this case, the shift down operation by the shift down section 48 is not carried out and the the integer portion of the waveform address data INT-3 is directly supplied to the adder 50 with no operation.

The adder 50 totals the integer portion of the waveform address data INT-3, the start address TADDC of the memory areas in which the waveform data corresponding to the designated tone color are stored and the output data of the interpolation counter 49. In this case, the data [0], [1], [2] and [3] are sequentially outputted from the interpolation counter 49 in order to read out the four waveform data to be used for the four points interpolation. Therefore, the successive four address data TADDC+INT-3, TADDC+INT-2, TADDC+INT-1 and TADDC+INT are sequentially outputted from the adder 50 and are supplied to the waveform memory 6.

The four successive waveform data corresponding to the addresses TADDC+INT-3, TADDC+INT-2, TADDC+INT-1 and TADDC+INT are sequentially read out from the waveform memory 6 and the waveform data thus read out are supplied to the interpolating section 19 of the tone generating section 8. In the interpolating section 19, the four successive waveform data supplied from the waveform memory 6 are sequentially supplied to the multiplier 107. On the other hand, the four interpolation coefficients, which correspond to the fractional portion of the waveform address data, are sequentially supplied from the coefficients memory 103 to the multiplier 107 via the selector 105 in synchronization with the supply of the waveform data. As a result, the four products of the waveform data and the interpolation coefficients corresponding to the waveform data are sequentially outputted from the multiplier 107 and the products thus outputted are accumulated by the accumulator 108. The accumulated result, i.e., the interpolated waveform data is supplied from the accumulator 108 to the envelope multiplication section 21 as shown in FIG. 12.

On the other hand, under the time division control, the envelope data corresponding to the thirty two time division channels are generated based on the envelope control signals supplied from the envelope control register section 17. The envelope data thus generated are sequentially supplied to the envelope multiplication section 21.

The interpolated waveform data of each time division channel is multiplied by the envelope data corresponding to the channel by the envelope multiplication section 21 to generate the musical tone data of the corresponding time division channel. As a result, the musical tone data corresponding to the thirty two time division channels are sequentially outputted from the envelope multiplication section 21 in synchronization with change of time division channel. The musical tone data corresponding to the thirty two channels are accumulated by the channel accumulating section 33. As a result, the mixed musical tone data including the thirty two waveform data is obtained from the channel accumulating section 33.

In this manner, the mixed musical tone data are sequentially generated and the mixed musical tone data thus generated are sequentially supplied to the DAC 23 in synchronization with change of the sampling period. As a result, analog musical tone signal is obtained from the DAC 23 and is outputted from the sound system 10 as a musical sound.

In this case-A, there is no limitation with respect to the tone pitch of the musical tone.

(8-2) Case-B

The description will be given with respect to the operation of the second type of electronic musical instrument in which no external device is employed and musical tones are generated by the two chips of the tone generating sections **8*a* and 8*b* as shown in FIG. 2B. In this case, the external device designating signal OP having the value [0], the double chip signal C2 having the value [1] and the master signal MC having the value [1] are supplied to the master tone generating section 8*a* while the external device designating signal OP having the value [0]. the double chip signal C2 having the value [1] and the master signal MC having the value [0] are supplied to the slave tone generating section 8*b*. The interpolation control signal P2 is set to [1] for all time division channels. Therefore, all musical tones are generated by the tone generating sections 8*a* and 8*b* by using the two points interpolation. The compression control signal COMP is set to [0] for all time division channels. Therefore, all musical tones are generated based on the non-compressed waveform data stored in the waveform memory 6. The waveform address data stored in the address RAM 38** are sequentially updated in synchronization with change of sampling period. This operation has already been described in the description regarding to the case-A. Therefore, the description regarding to this operation is omitted.

In the address generating section 18 of each tone generating section, the value [−2] is selected by the selector 43 when the interpolation control signal P2 is [1]. Therefore, the integer portion INT of the waveform address data latched by latch 45 is added with [−2] by the adder 47 and the address data INT-2 is outputted by the adder 47. The compressed waveform data are not used but only non-compressed waveform data are used for tone generation. Therefore, the address data INT-2 is supplied to the adder 50 via the shift down section 48 with no shift down operation.

In the address generating section 18 of the master tone generating section 8*a*, the data [0], [1], [0] and [1] are sequentially supplied from the interpolation counter 49 to the adder 50 in synchronization with change of time slot during one time division channel (i.e., four time slots). Furthermore, the start address TADDC of the memory areas of the waveform memory 6 in which the waveform data of the musical tone to be generated are stored is supplied to the adder 50. Therefore, the four address data TADDC+INT-2, TADDC+INT-1, TADDC+INT-2 and TADDC+INT-1 are sequentially outputted from the adder 50 to the gate circuit 51. The gate circuit 51 is enabled during the first half of the time division channel (i.e., during the first and second time slot). Therefore, the address data TADDC+INT-2 and TADDC+INT-1, which are outputted during the first and second time slots, are supplied to the waveform memory 6 via the gate circuit 51.

In the address generating section 18 of the slave tone generating section 8*b*, the gate circuit 51 is enabled during the latter half of the time division channel (i.e., during the third and fourth time slot). Therefore, the latter two address data, which are outputted from the adder 50 during the third and fourth time slots, are supplied to the waveform memory 6 via the gate circuit 51.

As a result, the four waveform data are sequentially read out from the waveform memory 6. The two waveform data read out during the first half are the waveform data which are required by the master tone generating section 8*a*. The two waveform data read out during the latter half are the waveform data which are required by the slave tone generating section 8*b*. The four waveform data thus read out are sequentially supplied to the interpolating section 19 of the master tone generating section 8*a* and to the interpolating section 19 of the slave tone generating section 8*b*.

In the interpolating section 19 (FIG. 9) of the master tone generating section 8*a*. the output data of the bit inverting section 104 (i.e., the data 1-FRAC) is selected by the selector 105 during the first time slot T1 and the fractional portion FRAC of the waveform address data (the data latched by the latch 46 in FIG. 3) is selected by the selector 105 during the second time slot T2. The data 1-FRAC and FRAC thus selected are sequentially supplied to the multiplier 107 as interpolation coefficients during the time slots T1 and T2. During the time slots T3 and T4, no data is selected by the selector 105 and the data [0] is supplied to the multiplier 107.

On the other hand, the four waveform data read out from the waveform memory are stored In the delay circuit 106 of the interpolating section 9 of the master tone generating section 8*a* and in that of the slave tone generating section 8*b*.

In the interpolating section 19 of the master tone generating section 8*a*, the four waveform data are sequentially read out from the delay circuit 106 during the time slots T1 to T4. As a result, the first and the second waveform data of the four waveform data are respectively multiplied by the first interpolation coefficient 1-FRAC and the second interpolation coefficient FRAC and the first and the second products are sequentially outputted from the multiplier 107 during the first and second time slots T1 and T2. The data [0] is outputted from the multiplier 107 during the time slots T3 and T4. The multiplied results thus outputted from the multiplier 107 are accumulated by the interpolating accumulator 108. As a result, the interpolated waveform data is obtained from the accumulator 108.

In the interpolating section 19 of the slave tone generating section 8*b*, the four waveform data are sequentially read out from the delay circuit 106 during the time slots T1 to T4. During the time slots T1 and T2, the data [0] is outputted from the multiplier 107 because the data [0] is supplied from the selector 105 to the multiplier 107. During the time slots T3 and T4, the third and the fourth waveform data of the four waveform data are respectively multiplied by the first interpolation coefficient 1-FRAC and the second interpolation coefficient FRAC and the first and the second products are sequentially outputted from the multiplier 107. The multiplied results thus outputted from the multiplier 107 are accumulated by the interpolating accumulator 108. As a result, the interpolated waveform data is obtained from the accumulator 108. The interpolated waveform data are calculated as described above for the thirty two time division channels.

In the master tone generating section 8*a*, the interpolated waveform data corresponding to the thirty two time division channels are sequentially supplied to the envelope multiplication section 21. On the other hand, the envelope data corresponding to the thirty two time division channels are sequentially generated by the envelope generating section 20 based on the envelope control data stored in the envelope control register section 17. The envelope data thus generated are sequentially supplied to the envelope multiplication section 21 and are multiplied by the envelope data. As a result, musical tone data corresponding to the thirty two time division channels are obtained. The musical tone data are accumulated by the channel accumulator 22 and the mixed musical tone data containing the thirty two musical tone data are sequentially supplied to the DAC 23. As a result, the analog musical tone signal is outputted from the DAC 23 and is outputted from the sound system 10 as musical sound.

The same operation is carried out in the slave tone generating section.

Therefore, sixty four musical tones may be generated by the master and slave tone generating sections 8*a* and 8*b*.

In this case-B, there is no limitation with respect to the tone pitch of the musical tone.

(8-3) Case-C

The description will be given with respect to the operation of the third type of electronic musical instrument in which one chip of the tone generating section 8 is used for tone generation and one external device is inserted between the waveform memory 6 and the tone generating section as shown in FIG. 2C. In this case, the external device designating signal OP having the value [2], the double chip signal C2 having the value [0] and the master signal MC having the value [1] are supplied to the tone generating section 8. The interpolation control signal P2 is set to [0] for all time division channels. Therefore, all musical tones are generated by the tone generating section 8 by using the four points interpolation. The non-compressed waveform data and the compressed waveform data can be used for tone generation because the external device 7 is inserted between the waveform memory 6 and the tone generating section 8.

In the tone generating section 8, the external device designating signal OP having the value [2] is supplied to the offset generating section 36. Therefore, the offset data [+4], [+2], [0] and [+4] are sequentially generated by the offset generating section 36 during the time slots T1 to T4.

During the time slot T1, the output data of the channel counter 35 is added with the offset data [+4] by the full adder 37 and the added result is supplied to the address RAM 38 as read out address. As a result, the waveform address data corresponding to the coming time division channel, which is latter than the present time division channel by four time division channels, is read out from the address RAM 38. The waveform address data thus read out is latched by the latch 39.

During the time slot T2, the offset data [+2] is supplied to the full adder 37. Therefore, the waveform address data corresponding to the coming time division channel, which is latter than the present time division channel by two time division channels, is read out from the address RAM 38. The integer portion of the waveform address data thus read out is latched by the latch 45.

During the time slot T3, the offset data [+0] is supplied to the full adder 37. Therefore, the waveform address data corresponding to the present time division channel is read out from the address RAM 38. The fractional portion of the waveform address data thus read out is latched by the latch 46.

During the time slots T2 and T3, the integer portion and the fractional portion of the waveform address data, which has been latched by the latch 39 during the time slot T1, are respectively supplied to the full adders 31 and 32. On the other hand, the pitch data, which designates the pitch of the musical tone to be generated, is supplied to the F-number generating section 30 and the F-number is generated by the F-number generating section 30 based on the pitch data. The integer portion and the fractional portion of the F-number thus generated are respectively supplied to the full adders 31 and 32. As a result, the waveform address data supplied from the latch 39 is added with the F-number by the full adders 31 and 32 and the added result is outputted by the fuller adders 31 and 32 as a new waveform address data. The new waveform address data thus outputted is supplied to the input terminal DI of the address RAM 38 via the address control section 34.

During the time slot T4, the offset data [+4] is added with the channel number of the present time division channel and the added result is supplied to the address RAM 38. The write operation is then carried out on the address RAM 38. As a result, the new waveform address data, which has been obtained during the time slots T2 and T3, is written in the memory area of the waveform memory 6 which corresponds to the coming time division channel which is latter than the present time division channel by four time division channels.

In this manner, the waveform address data corresponding to the coming time division channel, which is latter than the present time division channel by four time division channels, is updated during the present time division channel.

During the time slots T2 and T3 of the present time division channel, the integer portion and the fractional portion of the waveform address data of the coming time division channel, which is latter than the present time division channel by two time division channels, are latched by the latches 45 and 46 as described above. These latched data are used for generating the interpolated waveform data as follows.

The operation of the selector 43 is controlled based on whether the waveform data read out from the waveform memory 6 are compressed waveform data or not, i.e., whether the compression control signal COMP is [1] or not.

When compressed waveform data are read out from the waveform memory 6 and the compression control signal COMP is [1], the back step data outputted by the back step data generating section 42 is selected by the selector 43. When non-compressed waveform data are read out from the waveform memory 6 and the compression control signal COMP is [0], the value [−2] or [−3] may be selected by the selector 43. In this preferred embodiment, the value [−3] is selected by the selector to use the four points interpolation which provides high fidelity regarding to tone generation.

The output data of the selector 43 is supplied to the adder 47 via the bit extending section 44. On the other hand, the integer portion of the waveform address data is supplied from the latch 45 to the adder 47. The integer portion of the waveform address data is added with the output data of the selector 43 by the adder 47. The output data of the adder 47 is supplied to the shift down section 48 and the LSB (Least Significant Bit) of the output data is supplied to the interpolating section 19 as the signal ODD. When the compression control signal COMP is [1], the shift down section 48 outputs the shifted data, the value of which is ½ of the output data of the adder 47. The output data of the shift down section 48 is supplied to the adder 50.

The adder 50 totals the output data of the shift down section 48, the start address of the memory areas of the waveform memory 6 in which the waveform data of the musical tone to be generated are stored and the output data of the interpolation counter 49. In this case-C, one tone generating section is used for tone generation. Therefore, the data [0], [1], [2] and [3] are sequentially outputted by the interpolation counter 49 during the time slots T1 to T4. The gate circuit 51 is enabled during all time slots. Therefore, the all output data of the adder 50 are supplied to the waveform memory 6 via the gate circuit 51.

As mentioned above, the selecting operation of the selector 43 is controlled based on whether compressed waveform data are read out from the waveform memory 6 or not. When compressed waveform are sequentially read out from the waveform memory 6 and decoded to the non-compressed waveform data, the decoding operation for the compressed waveform data thus read out requires the non-compressed waveform data which is prior to the non-compressed waveform data corresponding to the present compressed waveform data. But, each compressed waveform data may be read out from the waveform memory once because the non-compressed waveform data corresponding to the past compressed waveform data which has been read out from the waveform memory 6 and decoded during the prior sampling period are stored in the buffer RAM 70 of the decoding circuit 64 of the external device 7. Therefore, the selecting operation of the selector 43 is controlled so that the compressed waveform data following to the past compressed waveform data which has been previously read out and decoded during the prior sampling period is read out from the waveform memory during the first time slot.

On the other hand, when non-compressed waveform data are read out from the waveform memory 6, the selector selects the value [−3]. As a result, the successive four non-compressed waveform data to be used for the four points interpolation are read out from the memory 6. In this case, the non-compressed waveform data corresponding to the waveform address data latched by the latch 45 is read out from the waveform memory during the last time slot.

The four compressed waveform data read out from the waveform memory 6 are supplied to the external device 7. In the external device 7, the output data of the delay circuit 56 which delays the input data by two time slots is selected by the selector 57.

When compressed waveform data (8 bit data) are supplied to the selector 58, the selecting operation of the selector 58 is controlled based on the signal ODD. When the signal ODD is [0], the input terminals A, D, C and E are sequentially selected during the first to fourth time slots. As a result, the first waveform data I, the second waveform data II, the third waveform data III and the fourth waveform data IV are sequentially outputted from the selector 58 as shown in FIG. 7*a*. When the signal ODD is [1], the input terminals B, A, D and C are sequentially selected during the first to fourth time slots in order to sequentially output the waveform data I to IV. The waveform data (8 bit data) thus outputted from the selector 58 are extended to 16 bit data and the 16 bit data are supplied the decoding circuit 64 shown in FIG. 64.

When non-compressed waveform data are supplied from the selector 57 to the selector 58, the input terminal A is selected by the selector 58 and the gate 62 is enabled. As a result, the upper 8 bit data and the lower 8 bit data constituting the output data of the selector 57 are respectively supplied to the non-linear extending section 63 by the gate 62 and the selector 58. In this case, the non-compressed waveform data thus supplied are supplied to the decoding circuit 64 by the non-linear extending section 63 with no operation.

Next, the description will be given with respect to the operation for decoding the secondary LPC compressed waveform data which is carried out by the decoding section 63.

In the decoding section 63, during each time division channel, the last four non-compressed waveform data, for example, the data $W_{-1}$, $W_{-2}$, $W_{-3}$ and $W_{-4}$ which has been decoded by using the same time division channel, are read out from the buffer RAM 70 and the four non-compressed waveform data thus read out are held by the latches 71 to 74 in the order of the sequence of them. More specifically, the newest non-compressed waveform data $W_{-1}$ is held by the latch 71 and the oldest non-compressed waveform data $W_{-4}$ is held by the latch 74.

During the last time slot of the time division channel, the four non-compressed waveform data $W_{-1}$ to $W_{-4}$ held in the latches 71 to 74 are respectively selected by the selectors 75 to 78. In FIG. 11, U indicates these four non-compressed waveform data $W_{-1}$ to $W_{-4}$. The four non-compressed waveform data thus selected are delayed by the delay circuits 83 to 86 by one time slot and the four non-compressed waveform data thus delayed are fed back to the third input terminals of the selectors 75 to 78.

The non-compressed waveform data $W_{-1}$, which is outputted by the selector 75, is one sample prior to the non-compressed waveform data corresponding to the compressed waveform data $CW_0$, which is supplied to the adder 91 and to be decoded. The non-compressed waveform data $W_{-2}$, which is outputted by the selector 76, is two samples prior to the non-compressed waveform data corresponding to the compressed waveform data $CW_0$. These two non-compressed waveform data are respectively supplied to the multipliers 87 and 88 and the non-compressed waveform data thus supplied are multiplied by the LPC decoding coefficients $A_0$ and $A_1$. The multiplied results $A_0W_{-1}$ and $A_1W_{-2}$ are added by the adder 89. The output data of the adder 89 is supplied to the adder 91 via the gate 90 and the data thus supplied is added with the input compressed waveform data $CW_0$, which is supplied from the waveform memory 6 and to be decoded. As a result, the data $CW_0+A_0W_{-1}+A_1W_{-2}$, i.e., the non-compressed waveform data $W_0$ corresponding to the input compressed waveform data $CW_0$ is outputted by the adder 91. The non-compressed waveform data $W_0$ thus outputted is supplied to the second input terminal of the selector 75 and to the second input terminal of the selector 93 via the delay circuit 92.

When decoding the DPCM compressed waveform data, the data [1] and [0] are used the decoding coefficients.

During the next time slot, the selecting operations of the selectors 75 to 78 are controlled based on the increment signal INC1 and the input data of the second input terminal or of the third input terminal are selected. When the increment signal INC1 is [1], the second input terminals are selected by the selectors. As a result, the output data of the delay circuits 92, 83, 84 and 85, i.e., the non-compressed waveform data $W_0$, $W_{-1}$, $W_{-2}$ and $W_{-3}$ are respectively written in the delay circuits 83, 84, 85 and 86 via the selectors 75 to 78. When the increment signal INC1 is [0], the third input terminals are selected by the selectors 75 to 78. In this case, the data held in the delay circuits 83 to 86, i.e., the non-compressed waveform data $W_{-1}$, $W_{-2}$, $W_{-3}$ and $W_{-4}$ are not updated.

During the next time slots, the selecting operations of the selectors 75 to 78 are controlled based on the increment signals INC2 and INC3 in the same manner.

More specifically, the successive compressed waveform data are supplied to the adder 91 of the decoding circuit 64. On the other hand, the increment signals INC (INC1 . . .), the number of which equals to the number of the compressed waveform data to be decoded, are generated by the increment signal generating section 41. For example, when one compressed waveform data $CW_0$ is to be decoded, the increment signal INC1 is generated by the increment signal generating section 41. When two compressed waveform data $CW_0$ and $CW_1$ are to be decoded, the increment signals INC1 and INC2 are sequentially generated. When three compressed waveform data $CW_1$, $CW_2$ and $CW_3$ are to be decoded, the increment signals INC1, INC2 and INC3 are sequentially generated.

The supply of the compressed waveform data $CW_0$, $CW_1$, . . . and the data shift operation by the selectors 75 to 78 and the delay circuits 92, 83 to 86 in synchronization with the increment signals.

As a result, the non-compressed waveform data $W_0$, $W_1$, . . . are sequentially obtained from the adder 91 through the decoding operation described above. The non-compressed waveform data thus obtained are sequentially supplied to the selector 75 to be used for decoding the next compressed waveform data.

During the last time slot of the time division channel, the increment signal INC4 is generated. The selecting operation of the selectors 93 to 94 is controlled based on the increment signal INC4. When the increment signal INC4 is [1] during this time slot, the four compressed waveform data $CW_0$, $CW_1$, $CW_2$ and $CW_3$ have been supplied to the decoding circuit 64. In this case, the non-compressed waveform data $W_0$, $W_1$, $W_2$ and $W_3$, which correspond to the input compressed waveform data $CW_0$, $CW_1$, $CW_2$ and $CW_3$, are stored in the latches 85, 84, 83 and 92. Therefore, the second input terminals are selected by the selectors 93 to 96 and the non-compressed waveform data $W_3$, $W_2$, $W_1$ and $W_0$ are respectively supplied from the delay circuits 92, 83, 84 and 85 to the delay circuits 97 to 100. The non-compressed waveform data $W_3$, $W_2$, $W_1$ and $W_0$ thus supplied are respectively written in the delay circuits 97 to 100.

When the increment signal INC4 is [0] during this time slot, the decoding circuit 64 has received the compressed waveform data, the number of which is less than four and corresponds to the number of the increment signals having the value [1]. Therefore, the following data may be stored in the delay circuits 83 to 86.

| case | delay 83 | delay 84 | delay 85 | delay 86 |
|---|---|---|---|---|
| INC1 − 3 = [0] | $W_{-1}$ | $W_{-2}$ | $W_{-3}$ | $W_{-4}$ |
| INC1 = [1] | $W_0$ | $W_{-1}$ | $W_{-2}$ | $W_{-3}$ |
| INC1 − 2 = [1] | $W_1$ | $W_0$ | $W_{-1}$ | $W_{-2}$ |
| INC1 − 3 = [1] | $W_2$ | $W_1$ | $W_0$ | $W_{-1}$ |

In the above, $W_{-1}$ to $W_{-4}$ are past non-compressed waveform data which have been obtained through the decoding operation of the past sampling period and have been read out from the buffer RAM 70 to be used for the decoding operation of the present sampling period. $W_0$ to $W_2$ are new non-compressed waveform data which are obtained during the present sampling period.

In the above cases, the third input terminals are selected by the selectors 93 to 96 and the non-compressed waveform data stored in the delay circuits 83, 84, 85 and 86 are supplied to the delay circuits 97 to 100 via the selectors 93 to 96.

During the next time slots, the first input terminals are selected by the selector 93 to 96. Thus, the four data stored in the delay circuits 97 to 100 are sequentially shifted through the delay circuits and outputted from the decoding circuit 64 during the successive four time slots following to the present time slot. These four data includes the new non-compressed waveform data which have been obtained through the decoding operation during the present time division channel and the other non-compressed waveform data which have been obtained through the decoding operation during the past time division channel. The new non-compressed waveform data are stored in the memory areas of the buffer memory 70 corresponding to the present time division channel.

Next, the description will be given with respect to the operation of the decoding circuit 64 when the non-compressed waveform data are regenerated.

In this case, the compression control signal COMP is set to [0]. When regenerating non-compressed waveform data, four non-compressed waveform data are sequentially supplied to the adder 91 of the decoding circuit 64 via the non-linear extending section. The four non-compressed data should be supplied to the interpolation 19 to be used for the four points interpolation.

The increment signal generating section 41 generates the increment signal INC consisting of four pulses (i.e., INC1, INC2, INC3 and INC4).

In the decoding circuit 64 (FIG. 8), the gate circuit 90 is closed and the value [0] is supplied to the adder 91 because the compression control signal COMP is [0].

Therefore, the first to third non-compressed waveform data supplied from the non-linear extending section are sequentially shifted and stored in the delay circuits 83 to 85 by the increment signals INC1 to INC3 via the adder 91 and the delay circuit 92. When the increment signal INC4 is generated, the four non-compressed waveform data are stored in the delay circuits 97 to 100 via the selectors 93 to 96. The four non-compressed waveform data thus stored are sequentially outputted from the decoding circuit 64 during the successive four time slots. In this manner, the non-compressed waveform data supplied from the non-linear extending section 63 are supplied to the interpolating section 19 via the decoding circuit 64 with no operation. As described above, the four successive non-compressed waveform data are sequentially obtained from the decoding circuit 64. The non-compressed waveform data thus obtained are sequentially supplied to the interpolating section 19 (FIG. 9) of the tone generating section 8 (FIG. 1). In this case-C, the interpolation control signal P2 is [0] and the four points interpolation is to be carried out. Therefore, the interpolation coefficients read out from the coefficients memory 103 are selected by the selector 105 and the coefficients thus selected are sequentially supplied to the multiplier 107. On the other hand, the four successive waveform data supplied from the decoding circuit 64 are sequentially supplied to the multiplier 107. As a result, the four products of the waveform data and the interpolation coefficients corresponding to the waveform data are sequentially outputted from the multiplier 107 and the products thus outputted are accumulated by the accumulator 108. The accumulated result. i.e., the interpolated waveform data is supplied from the accumulator 108 to the envelope multiplication section 21.

On the other hand, under the time division control, the envelope data corresponding to the thirty two time division channels are generated based on the envelope control signals supplied from the envelope control register section 17. The envelope data thus generated are sequentially supplied to the envelope multiplication section 21.

The interpolated waveform data of each time division channel is multiplied by the envelope data corresponding to the channel by the envelope multiplication section 21 to generate the musical tone data of the corresponding time division channel. As a result, the musical tone data corresponding to the thirty two time division channels are sequentially outputted from the envelope multiplication section 21 in synchronization with change of time division channel. The musical tone data corresponding to the thirty two channels are accumulated by the channel accumulating section 33. As a result, the mixed musical tone data including the thirty two waveform data is obtained from the channel accumulating section 33.

In this manner, the mixed musical tone data are sequentially generated and the mixed musical tone data thus generated are sequentially supplied to the DAC 23 in synchronization with change of the sampling period. As a result, analog musical tone signal is obtained from the DAC 23 and is outputted from the sound system 10 as a musical sound.

In this case-C, there is no limitation with respect to the tone pitch of the musical tone when the musical tone is generated based on the non-compressed waveform data stored in the waveform memory 6. But, the F-number is limited within [4] (i.e., the frequency of the musical tone is limited within 200 kHz) when the musical tone is generated based on the compressed waveform data stored in the waveform memory 6. Because, all compressed waveform data should be read out from the waveform memory 6 to obtain the non-compressed waveform data which are used for the interpolation.

(8-4) Case-D

The description will be given with respect to the operation of the fourth type of electronic musical instrument in which musical tones are generated by the two chips of the tone generating sections 8*a* and 8*b* and the two external devices 7*a* and 7*b* are inserted between the waveform memory 6 and the tone generating sections as shown in FIG. 2D.

In this case, the external device designating signal OP having the value [2], the double chip signal C2 having the value [1] and the master signal MC having the value [1] are supplied to the master tone generating section 8*a* while the external device designating signal OP having the value [2], the double chip signal C2 having the value [1] and the master signal MC having the value [0] are supplied to the slave tone generating section 8b.

In this case-D, musical tones corresponding to sixty four channels are generated by the tone generating sections 8a and 8b by using the four points interpolation.

In the address generating section 18 of the master tone generating section 8a, the offset data [+4], [+2], [0] and [+4] are sequentially generated by the offset generating section 36 during the time slots T1 to T4 because the external signal OP is [2].

During the first time slot T1, the waveform address data corresponding to the coming time division channel, which is latter than the present time division channel by four time division channels, is read out from the address RAM 38. The waveform address data thus read out is latched by the latch 39.

During the time slot T2, the waveform address data corresponding to the coming time division channel, which is two channels latter than the present time division channel, is read out from the address RAM 38. The integer portion of the waveform address data thus read out is latched by the latch 45.

During the time slot T3, the waveform address data corresponding to the present time division channel is read out from the address RAM 38. The fractional portion of the waveform address data thus read out is latched by the latch 46.

During the time slots T2 and T3, the integer portion and the fractional portion of the address data in the latch 39, which corresponds to the coming time division channel which is four channels latter than the present channel, are respectively supplied to the full adders 31 and 32. As a result, the waveform data in the latch 39 is added with the F-number generated by the F-number generating section 30 and the added result is supplied to the address RAM 38 via the address control section 34 as an updated waveform address data.

During the time slot T4, the updated waveform data thus supplied is written in the memory area of the address RAM 38 which corresponds to the coming time division channel which is four channels latter than the present time division channels.

In this manner, the waveform address corresponding to the coming time division channel which is four channels latter than the present channel is updated by using the time slots T1 and T4 of the present time division channel.

In this case-D, the tone generating sections 8a and 8b can generates musical tones based on compressed waveform data stored in the waveform memory 6 by using the decoding function of the the external circuits 7a and 7b.

The master and slave tone generating section 8a and 8b alternatively access the waveform memory. That is to say, each tone generating section can access the waveform memory during two time slots in one time division channel. Therefore, only two waveform data can be read out from the waveform memory 6 by each tone generating section. However, each tone generating section can generate musical tone by using the four points interpolation which needs four waveform data. Because, the external devices 7a and 7b act as waveform data buffers which store the waveform data read out from the waveform memory and supply them to the tone generating sections. Two waveform data can be read out from the waveform memory 6 for each tone generating section. But, four waveform are supplied from each external device to each tone generating section.

When musical tones are generated based on compressed waveform data stored in the waveform memory 6, the F-number is limited within [2]. When musical tones are generated based on non-compressed waveform data stored in the waveform memory 6, the F-number is limited within [3]. Because, a plurality of new waveform data should be read out from the waveform memory 6 when generating musical tones having such a high tone pitch.

Next, the description will be given with respect to the operation in which compressed waveform data are regenerated.

When regenerating compressed waveform data in the case-D, the operations of the selector 43 and shift down section 48 are same as those in the case-C. That is to say, the selector 43 selects the back step data outputted by the back step data generating section 43. The shift down section 48 shift down the bits of the input data by one bit. The address step data ΔI is limited within [3]. The back step data generating section 42 generates the back step data based on the address step data ΔI thus limited. The increment signal generating section 41 generates the Increment signal INC consisting of increment pulses, the number of which corresponds to the back step data. The adder 50 receives the waveform address data from the adder 47 via the shift down section 48 as same as the case-C. But, the adder 50 sequentially receives the four data [0], [1], [0] and [1] from the interpolation counter 49 during the time slots T1 to T4. As a result, two successive memory address data are outputted from the adder 50 twice during one time division channel. In the master tone generating section 8a, the first half of them are selected by the gate circuit 51 and the data thus selected are sequentially supplied to the waveform memory 6. On the other hand, in the slave tone generating section 8b, the latter half of the four memory address data outputted by the adder 50 are selected by the gate 51 and the two memory address data thus selected are supplied to the waveform memory 6.

The decoding operation of the external devices 7a and 7b and the interpolation operation of the tone generating sections 8a and 8b are same as those of the case-C. Thus, the description for them is omitted.

Next, the description will be given with respect to the operation in which non-compressed waveform data are regenerated.

In this case, the selector 43 of the address generating section 18 selects the back step data outputted by the back step data generating section 42. As described above, the address step data ΔI is limited within [2]. The increment signal INC and the back step data are generated based on the address step data ΔI. The adder 47 adds the integer portion of the waveform address data stored in the latch 45 with the back step data. The added result of the adder 47 designates the waveform address of the non-compressed waveform data which is to be read out for the interpolation at first. The output data of the adder 47 is supplied to the adder 50 via the shift down section 48 with no operation because the compression control signal COMP is [0]. The four data [0], [1], [0] and [1] are sequentially supplied from the interpolation counter 49 to the adder 50. Therefore, the four memory address data are sequentially outputted by the adder 50. In the address generating section 18 of the master tone generating section 8a, the first half of the four memory address data are selected by the gate circuit 51 and the two address data thus selected are sequentially supplied to the waveform memory 6.

As a result, the non-compressed waveform data are read out from the waveform memory 6. In this case-D, only two waveform data can be read out from the waveform memory 6 for one time division channel. But, the four points interpolation can be carried out by using the past waveform data which have been read out from the waveform memory 6 and have been stored in the buffer RAM 70 of the decoding circuit 64 of the external device 7*a* or 7*b*. That is to say, the buffer RAMs 70 of the external devices 7*a* and 7*b* act as waveform data buffer for storing the waveform data which are necessary for the interpolation.

More specifically, in the address generating section 18, the waveform address data, for example, the waveform address $WA_0$, outputted by the adder 47 designates the waveform data $W_0$ which follows the last waveform data of the four waveform data $W_{-1}$, $W_{-2}$, $W_{-3}$ and $W_{-4}$ which are stored in the buffer RAM 70 of the decoding circuit 64 of the external device 7*a*. When the waveform address data $WA_0$ is outputted from the adder 47, the four memory address data $WA_0$+TADDC, $WA_0$+TADDC+1, $WA_0$+TADDC and $WA_0$+TADDC+1 are sequentially outputted by the adder 50. The first half of the four memory address data thus outputted are supplied to the waveform memory 6 and the waveform data W1 and W2 corresponding to the waveform address data $WA_0$ and $WA_{0+1}$ are sequentially supplied from the waveform memory 6 to the decoding circuit 64 of the external device 7*a*.

When the address step data "$I is [1], the increment signal INC1 having the value [1] is supplied to the decoding circuit 64. As a result, the waveform data $W_0$ corresponding to the waveform address data $WA_0$ is received by the decoding circuit 64 and the waveform data $W_{-3}$, $W_{-2}$, $W_{-1}$ and $W_0$ are sequentially outputted from the decoding circuit 64.

When the address step data "$I is [2], the increment signals INC1 and INC2 having the value [1] are sequentially supplied to the decoding circuit 64. As a result, the waveform data $W_0$ and $W_1$ corresponding to the waveform address data $WA_0$ and $WA_1$ are received by the decoding circuit 64 and the waveform data $W_{-2}$, $W_{-1}$, $W_0$ and $W_1$ are sequentially outputted from the decoding circuit 64.

As described above, the address step data "$I is limited within [2]. Therefore, the increment signals INC3 and INC4 having the values [1] are not generated.

Next, the description will be given with respect to the operation in which non-compressed waveform data are read out to be used for the two points interpolation.

In this case, the value [−2] is selected by the selector 43 of the address generating section 18. The value [−2] thus selected is added with the integer portion INT of the waveform address data, which is supplied from the latch 45, by the adder 44. The added result INT-2 is supplied to the adder 50 via the shift down 50 with no operation. The data [0], [1], [0] and [1] are sequentially supplied from the interpolation counter 49 to the adder 50. Furthermore, the start address data TADDC of the waveform data to be regenerated is supplied to the adder 50. As a result, the four memory address data TADDC+INT-2, TADDC+INT-1, TADDC+INT-2 and TADDC+INT-1 are sequentially outputted from the adder 50 during the time slots T1 to T4.

In the address generating section 18 of the master tone generating section 8*a*, the first half of the four memory address data are selected by the gate circuit 51 and the two memory address data thus selected are sequentially supplied to the waveform memory 6 during the time slots T1 and T2. In the address generating section 18 of the slave tone generating section 8*b*, the latter half of the four memory address data are selected by the gate circuit 51 and the two memory address data thus selected are sequentially supplied to the waveform memory 6 during the time slots T3 and T4.

In the address generating section 18 of the master tone generating section 8*a*, the data [1], [1], [1] and [1] are sequentially generated by the increment signal generating section 41 as the increment signals INC1 to INC4. In the address generating section 18 of the slave tone generating section 8*b*, the data [0], [0], [1] and [1] are sequentially generated by the increment signal generating section 41 as the increment signals INC1 to INC4. These increment signals are used for the external devices 7*a* and 7*b* to control the output timing at which the waveform data are supplied to the interpolation sections of the tone generating sections 8*a* and 8*b*.

The four waveform data, for example, the data I, II, III and IV are sequentially read out from the waveform memory 6 during one time division channel. The first half of the four waveform data, i.e., I and II are to be received by the master tone generating section 8*a*. The latter half of the four waveform data, i.e., III and IV are to be received by the slave tone generating section 8*b*.

In the external device 7*a*, the output data of the delay circuit 56 is selected by the selector 57. In the external device 7*b*, the output data of the delay circuit 55 is selected by the selector 57. Thus, the waveform data I and III are supplied to the selectors 57 of the external devices 7*a* and 7*b* at the same timing as shown in FIG. 11.

In the external devices 7*a* and 7*b*, the same operations are carried out with respect to the circuits between the selector 57 and the decoding circuit 64.

In each external device, the waveform data outputted from the selector 57 are supplied to the non-linear extending section 63 and to the decoding circuit 64. As a result, the four successive non-compressed waveform data are obtained from the decoding circuit 64 of each external device. The non-linear extending operation and the decoding operation have been previously described. Therefore, the description of them are omitted.

Next, the description will be given with respect to the operation in which musical tones are generated based on the non-compressed waveform data read out from the waveform memory 6.

In each external device, the non-compressed waveform data read out from the waveform memory are supplied to the decoding circuit 64 via the selector 57 and the non-linear extending section 63. In this case, no operation is carried out on the non-compressed waveform data by the non-linear extending section 63.

There are two cases in the operation of the decoding circuit 64. In the first case, four non-compressed waveform data are outputted by the decoding circuit 64 to be used for the four points interpolation during one time division channel. In the second case, two non-compressed waveform data are outputted by the decoding circuit 64 to be used for the two points interpolation during one time division channel.

In the first case, the buffer RAM 70 stores four non-compressed waveform data which have been previously read out from the waveform memory 6 and used for the four points interpolation to generate the interpolated waveform data corresponding to the same time division channel of the prior sampling period. The four non-compressed waveform data are read out from the buffer RAM 70 and are sequentially latched by the latches 71 to 74 before the first non-compressed waveform data I or III, which is read out from the waveform memory 6 during the present time division channel, is supplied to the adder 91.

The non-compressed waveform data are sequentially supplied from the waveform memory 6 to the adder 91 after the above four waveform data have been latched by the latches 71 to 74. On the other hand, the data [0] is supplied from the gate 90 to the adder 91 because the compression control signal COMP is [0] and the output data of the gate 90 is thereby set to [0]. Therefore, the non-compressed waveform data supplied from the waveform memory 6 are written in the delay circuit 92.

The increment signals are sequentially generated and the shift operation is carried out by the delay circuits 83 to 86 via the selectors 75 to 78 in synchronization with supply of the increment signals.

For example, when one waveform data I is supplied to the decoding circuit 64 of the external device 7*a*, the increment signal INC1 having the value [1] is is supplied to the decoding circuit. As a result, the following waveform data remain in the delay circuits 83 to 86 after the shift operation.

| Delay 83 | Delay 84 | Delay 85 | Delay 86 |
|---|---|---|---|
| I | $W_{-1}$ | $W_{-2}$ | $W_{-3}$ |

In the above, $W_{-1}$ to $W_{-3}$ are past waveform data which have been read out from the buffer RAM 70.

When two waveform data I and II are sequentially supplied to the decoding circuit 64 of the external device 7*a*, the increment signals INC1 and INC2 having the value [1] are sequentially supplied to the decoding circuit. As a result, the following data remain in the delay circuits 75 to 86 after the shift operation.

| Delay 83 | Delay 84 | Delay 85 | Delay 86 |
|---|---|---|---|
| II | I | $W_{-1}$ | $W_{-2}$ |

The increment signals INC3 and INC4 having the value [1] are not generated.

When the shift operation is completed, the waveform data stored in the delay circuits 83 to 86 are respectively written in the delay circuits 97 to 100 via the selectors 93 to 96.

The waveform data thus written are sequentially shifted through the delay circuits 97 to 100 and outputted from the decoding circuit 64. Furthermore, the four waveform data, which are outputted from the decoding circuit 64, are written in the memory area of the buffer RAM 70 corresponding to the present time division channel.

In this manner, the four waveform data are outputted from the decoding circuits of the external device 7*a* and 7*a*. The waveform data thus outputted are respectively supplied to the master and slave tone generating sections 8*a* and 8*b* to be used for the four points interpolations.

In the second case, two non-compressed waveform data are outputted by the decoding circuit 64 to be used for the two points interpolation during one time division channel.

In this case, four waveform data are sequentially read out from the waveform memory 6. The first half of the waveform data and the latter half of those are respectively supplied to the selectors 57 of the external circuits 7*a* and 7*b* at the same time. Thus, the waveform data to be regenerated by the master tone generating section 8*a* and the waveform data to be regenerated by the slave tone generating section 8*b* are respectively outputted from the external circuits 7*a* and 7*b* at the same time.

There is a difference between the supply timing at which the waveform data are to be supplied to the master tone generating section 8*a* for the two points Interpolation and the supply timing at which the waveform data are to be supplied to the slave tone generating section 8*b* for the two points interpolation. More specifically, the waveform data used for the two points interpolation should be outputted from the external device 7*b* two time slots after the waveform data are outputted from the external device 7*a*.

Therefore, the following control is carried out. As described above, the increment signals [1], [1], [1] and [1] are generated by the increment signal generating section 41 of the master tone generating section 8*a* while the increment signals [0], [0], [1] and [1] are generated by the increment signal generating section 41 of the slave tone generating section 8*b*. Therefore, the different shift operations are carried out in the decoding circuits of the external devices 7*a* and 7*b*. More specifically, four increment pulses are supplied to the decoding circuit 64 of the external device 7*a*. Therefore, the two waveform data to be used for the two points interpolation are stored in the delay circuits 85 and 86 when the shift operation is completed. In contrast, two increment pulses are supplied to the decoding circuit 64 of the external device 7*b*. Therefore, the two waveform data to be used for the two points interpolation are stored in the delay circuits 83 and 84 when the shift operation is completed. Thus, the two waveform data are supplied to the slave tone generating section 7*b* two time slots after the two waveform data are supplied to the master tone generating section 7*a*. In each tone generating section, the two points interpolation is carried out based on the waveform data thus supplied and the interpolated waveform data is obtained.

What is claimed is:

1. A musical tone generating apparatus operating based on a time division control method using a plurality of channels, said musical tone generating apparatus comprising:

a waveform memory for storing original waveform data;

first tone generating means for generating a plurality of addresses corresponding to said plurality of channels within a sampling period, and for reading out N samples of said original waveform data according to each address for each channel from said waveform memory, and for generating a plurality of musical tones based on said N samples corresponding to said plurality of channels within said sampling period;

second tone generating means for generating a plurality of musical tones adapted to be selectively installed in said musical tone generating apparatus for the purpose of increasing the number of musical tones that can be generated by said musical tone generating apparatus within said sampling period, the second tone generating means accessing the waveform memory together with the first tone generating means when the second tone generating means is used for tone generation; and access control means for decreasing the number of samples of said original waveform data read for each channel from said waveform memory from N to M, which is a number less than N, based on which each said musical tone of each said channel is generated, when the second tone generating means is installed.

2. A musical tone generating apparatus operating based on a time division control method using a plurality of channels, said musical tone generating apparatus comprising:

a waveform memory for storing original waveform data; and first tone generating means for generating a plurality of addresses corresponding to said plurality of channels within a sampling period, and for reading out N samples of said original waveform data according to each address for each channel from said waveform memory, and for generating a plurality of musical tones based on said N samples corresponding to said plurality of channels within said sampling period;

second tone generating means for generating a plurality of musical tones and buffer means for storing waveform data are adapted to be selectively installed in said musical tone generating apparatus to increase the number of musical tones generated by said musical tone generating apparatus in said sampling period;

wherein said second tone generating means accesses the waveform memory together with the first tone generating means when the second tone generating means is used for tone generation, and wherein said buffer means stores waveform data corresponding to the original waveform data which have been read out from the waveform memory during a past sampling period and supplies the stored samples of said original waveform data among said N samples, which cannot be read by said first tone generating means because of sharing access of said waveform memory with said second tone generating means, to said first tone generating means used for tone generation, when the second tone generating means is used for tone generation.

3. A musical tone generating apparatus operating based on a time division control method using a plurality of channels, said musical tone generating apparatus comprising:

a waveform memory for storing original waveform data having a compressed form;

address generating means for sequentially generating a plurality of addresses corresponding to said plurality of channels in a sampling period for reading out the original waveform data from the waveform memory under time division control;

buffer means for storing waveform data having a non-compressed form corresponding to the original waveform data which has been read out from the waveform memory in a previous sampling period;

data extending means for receiving the original waveform data read out from the waveform memory according to said addresses of each channel, and for carrying out an extending operation on the original waveform data of each channel to obtain non-compressed waveform data based on the waveform data stored in the buffer means and for writing the non-compressed waveform data of each channel obtained by the extending operation into the buffer means; and tone generating means for carrying out interpolations on the waveform data of each channel stored in the buffer means and the non-compressed waveform data of each channel obtained by the extending operation and for generating a plurality of musical tones corresponding to said plurality of channels based on the results of the interpolation.

4. A musical tone generating apparatus operating based on a time division control method using a plurality of channels, said musical tone generating apparatus comprising:

a waveform memory for storing original waveform data;

address generating means for sequentially generating a plurality of addresses corresponding to said plurality of channels within a sampling period, and outputting said plurality of addresses at predetermined timing to the waveform memory to read out the original waveform data from the waveform memory under time division control;

tone generating means for generating a plurality of musical tones based on the original waveform data read out from the waveform memory and corresponding to said plurality of channels within said sampling period;

external device means adapted to be inserted between said waveform memory and said tone generating means for carrying out an additional processing operation on the original waveform data read out from the waveform memory, and for outputting processed waveform data as the result of the processing operation to said tone generating means, when the external device means is inserted; and timing control means for controlling said address generating means to output said plurality of addresses at a timing earlier than said predetermined timing to said waveform memory when said external device means is inserted, so that the input timing of the waveform data into said tone generating means does not change irrespective of the installation of said external device means.

5. The musical tone generating apparatus of claim 1, wherein said first tone generating means further comprises means for interpolating between said N samples of said original waveform, wherein when said second tone generating means is used for tone generation the number of samples of said original waveform data interpolated by said interpolating means is changed from N to M.

6. The musical tone generating apparatus of claim 2, wherein said first tone generating means further comprises means for interpolating between said N samples of said original waveform.

7. The musical tone generating apparatus of claim 3, wherein said extending operation carried out by said data extending means further comprises linear predictive coding (LPC).

8. The musical tone generating apparatus of claim 4, wherein said timing control means is responsive to a selected type of said additional processing operation provided by said external device means to control said timing accordingly.

9. The musical tone generating apparatus of claim 4, wherein said additional processing operation further comprises an extending process of compressed waveform data.

10. The musical tone generating apparatus of claim 4, wherein said additional processing operation further comprises buffering of said waveform data for interpolation.

* * * * *